US007700251B2

(12) United States Patent
Nakai et al.

(10) Patent No.: US 7,700,251 B2
(45) Date of Patent: Apr. 20, 2010

(54) ELECTROPHOTOGRAPHIC PHOTOCONDUCTOR AND IMAGE-FORMING APPARATUS

(75) Inventors: Norio Nakai, Osaka (JP); Kazunari Hamasaki, Osaka (JP); Daisuke Kuboshima, Osaka (JP); Yoshio Inagaki, Osaka (JP); Hideki Okada, Osaka (JP); Tetsuya Ichiguchi, Osaka (JP); Keiji Maruo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 683 days.

(21) Appl. No.: 11/582,588

(22) Filed: Oct. 18, 2006

(65) Prior Publication Data

US 2007/0111118 A1 May 17, 2007

(30) Foreign Application Priority Data

Oct. 19, 2005 (JP) ..... 2005-304241

(51) Int. Cl.
*G03G 5/06* (2006.01)

(52) U.S. Cl. ..... 430/73; 430/70; 430/56; 430/58.75; 399/159

(58) Field of Classification Search ..... 430/56, 430/70, 73, 58.7; 399/159
See application file for complete search history.

(56) References Cited

U.S. PATENT DOCUMENTS

2007/0054209 A1 * 3/2007 Azuma et al. ..... 430/73

FOREIGN PATENT DOCUMENTS

DE 4232242 A1 * 4/1993
JP 07134430 A * 5/1995
JP 09194441 A * 7/1997
JP 2000112157 A * 4/2000
JP 2000-314969 11/2000
JP 2001-242656 9/2001
JP 2005107500 A * 4/2005

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
English translation of DE 4232242 (by EPO espacenet) (Apr. 1993).*
English language machine translation of JP 2005-107500 (Apr. 2005).*
English language machine translation of JP 2000-112157 (Apr. 2000).*

* cited by examiner

*Primary Examiner*—Christopher RoDee
(74) *Attorney, Agent, or Firm*—Carmody & Torrance LLP

(57) ABSTRACT

An electrophotographic photoconductor having an excellent crack resistance and wear resistance as well as excellent sensitivity characteristics, while keeping good image characteristics of the photoconductor is provided. In addition, an image-forming apparatus equipped with such an electrophotographic photoconductor is also provided. The electrophotographic photoconductor includes a photosensitive layer containing at least a charge-generating agent, a hole-transfer agent, and a binder resin on a conductive substrate. The hole-transfer agent has a solubility of 5 to 35% by weight with respect to triglyceride oleate and the photosensitive layer contains a compound represented by the following general formula (1) as an additive:

(1)

6 Claims, 6 Drawing Sheets

ELECTROPHOTOGRAPHIC PHOTOCONDUCTOR AND IMAGE-FORMING APPARATUS

BACKGROUND OF THE INVENTION

1. Field of the Invention

The present invention relates to an electrophotographic photoconductor and an image-forming apparatus provided therewith. In particular, the present invention relates to an electrophotographic photoconductor, which is excellent in contamination resistance and is capable of preventing the generation of exposure memory for a long period, and an image-forming apparatus provided with such an electrophotographic photoconductor.

2. Description of Related Art

Heretofore, organic photoconductors have been widely used as electrophotographic photoconductors, which contains a charge-generating agent for generating electric charges by light exposure and a charge-transfer agent for-transfer the generated charges, and a binder resin for dispersing these substances therein to form a layered structure.

An image-forming apparatus using such an organic photoconductor employs an image-forming process by sequentially arranging means for charging the surface of the photoconductor, means for irradiating light on the charged surface to form a latent image, means for developing the latent image with toner to form a toner image, and means for transferring the toner image onto a sheet of printing paper.

In this process of an image formation, a device for neutralization of electricity by light irradiation is arranged. Such a device is responsible for erasing residual electric charges remained on the surface of the photoconductor after the image transfer. Therefore, even in the case of repetitive use, the process is allowed to prevent the generation of the so-called transfer memory or exposure memory by resetting residual potentials remained in previous cycles of use.

However, space charges can be generated in the inside of the photoconductor even though such a process is employed. When the photoconductor is repeatedly used, the space charges are accumulated in the photoconductor. Therefore, there is a problem in that desired image characteristics can not be constantly obtained.

To solve such a problem, a positively-charged mono-layer type electrophotographic photoconductor has been disclosed (see patent document 1, for example). In this photoconductor, as well as the use of a specific electron-transfer agent, a terphenyl compound is used as an additive. Thus, even when a reversal development system is employed, it allows the photoconductor to retain the transfer memory in a small amount and have an improved gas resistance against NOx, ozone, and so on.

Furthermore, there is disclosed in an electrophotographic photoconductor having the stability of electric characteristics thereof in positive charging in repetitive use (see patent document 2, for example).

However, even though the use of such a photoconductor can lead to improvements in transfer memory and repetition stability to some extent, there is another problem in that residual electric charges can be generated on a photosensitive layer after transfer. In addition, in the process of repetitively using the photoconductor in this way, when any of contaminant components from a human body or from a contacting portion of the photoconductor has attached on the surface of the photoconductor, cracks can occur from the contaminant-attached portion, thereby causing a lowering in image characteristics. Furthermore, these photoconductors require a process of erasing residual charges using means for neutralization of electricity as an image-forming system, so that there is a further problem in that it is difficult to cope with miniaturization of a device.

[patent document 1] JP-2001-242656 A (Claims)

[patent document 2] JP-2000-314969 A (Claims)

SUMMARY OF THE INVENTION

Therefore, as a result of intensive studies for solving the above problems, the present inventors have found that the addition of a certain hole-transfer agent and a certain additive to a photosensitive layer could prevent the generation of exposure memory for a long period in addition to improve its ability of preventing the generation of cracks due to the presence of a contaminant component.

In other words, an object of the present invention is to provide an electrophotographic photoconductor, which is excellent in crack resistance and wear resistance and also excellent in sensitivity characteristics, while keeping good image characteristics for a long period, and to provide an image-forming apparatus comprising such an electrophotographic photoconductor.

According to the electrophotographic photoconductor of the present invention, there is provided an electrophotographic photoconductor comprising a photosensitive layer containing at least a charge-generating agent, a hole-transfer agent, and a binder resin on a conductive substrate, wherein the hole-transfer agent has a solubility of 5 to 35% by weight with respect to triglyceride oleate and the photosensitive layer contains a compound represented by the following general formula (1) as an additive, so that the above problems can be solved.

(1)

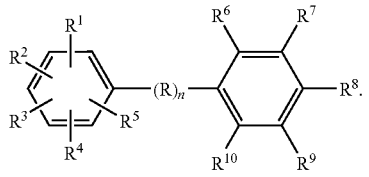

(In general formula (1), $R^1$ to $R^{10}$ are each independently selected from a hydrogen atom, a halogen atom, a substituted or unsubstituted alkyl group having 1 to 12 carbon atoms, a substituted or unsubstituted alkoxy group having 1 to 12 carbon atoms, a substituted or unsubstitued aryl group having 6 to 30 carbon atoms, a substituted or unsubstituted aralkyl group having 6 to 30 carbon atoms, a substituted or unsubstituted cycloalkyl group having 3 to 12 carbon atoms, a hydroxyl group, a cyano group, a nitro group, and an amino group; R is a substituted or unsubstituted alkylene group having 1 to 12 carbon atoms; and n is a integer of 0 to 3).

That is, the generation of cracks can be prevented by allowing the compound represented by the general formula (1) to act on a contaminant-attached portion, while the generation of exposure memory can be prevented by the use of the hole-transfer agent having a predetermined solubility prevents the generation of exposure memory.

Therefore, the photoconductor having such an excellent contamination resistance is capable of retaining good image characteristics for a long period and preventing the generation of exposure memory, thereby allowing an image-forming apparatus to be miniaturized by employing a system independent of the neutralization of electricity.

Furthermore, it is also found that the behavior of triglyceride oleate used in the invention can be equal to that of skin oil or finger oil considered as contaminant components derived from a human body, so that the contamination resistance of the surface of the photoconductor can be quantitatively evaluated using such triglyceride oleate.

For constructing the electrophotographic photoconductor of the present invention, the amount of the elution of the hole-transfer agent from surface of the electrophotographic photoconductor per unit area may preferably be in a range of 0.05 to 2 g/m$^2$ when the electrophotographic photoconductor is immersed in triglyceride oleate for 20 hours.

By constructing in this way, the electrophotographic photoconductor, which completely prevents the generation of cracks, may be obtained.

For constructing the electrophotographic photoconductor of the present invention, the amount of the additive added may preferably be in a range of 1.5 to 14% by weight with respect to a solid content of the photosensitive layer.

By constructing in this way, the amount of the additive added may be adjusted in response to the amount of the hole-transfer agent dissolved out, and thus the generation of cracks may be effectively prevented.

In addition, a decrease in glass transition point of the photosensitive layer may occur when the amount of the additive added increases. Thus, by adjusting the amount of the additive added within the range described above, the glass transition point may be controlled to keep the wear resistance at constant.

For constructing the electrophotographic photoconductor of the present invention, the glass transition point on the photosensitive layer may preferably be 60° C. or more. By constructing in this way, the glass transition point (Tg) of the photosensitive layer may be controlled within a predetermined range by the additive to allow the photoconductor to keep pressure resistance at constant, thereby imparting both the wear resistance and the crack resistance to the photoconductor in a balanced manner.

Furthermore, for constructing the electrophotographic photoconductor of the present invention, the additive may preferably be a compound represented by any of formulae (2) to (7) described below or a derivative thereof.

By constructing in this way, stress caused in the photosensitive layer may be further effectively eased. Thus, the additive prevents a decrease in wear resistance, while improving the crack resistance.

(2)

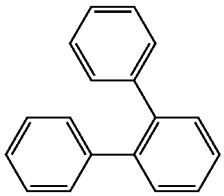

(BP-1)

-continued (3)

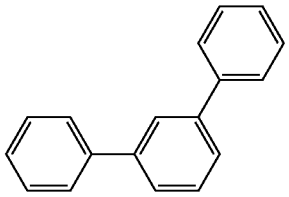

(BP-2)

(4)

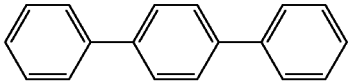

(BP-3)

(5)

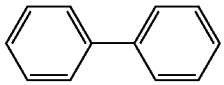

(BP-4)

(6)

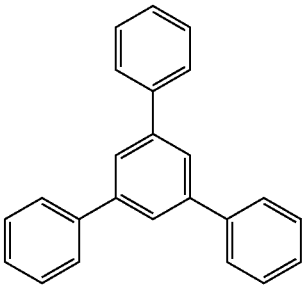

(BP-5)

(7)

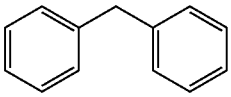

(BP-6)

Furthermore, for constructing the electrophotographic photoconductor of the present invention, the photosensitive layer may preferably be of a mono-layer type.

By constructing in this way, it may be applied on both positively- and negatively-charged types. Therefore, the layered structure of the photoconductor may be simplified and the productivity thereof may be thus improved.

Furthermore, another embodiment of the present invention is an image-forming apparatus comprising any of electrophotographic photoconductors described above. The image-forming apparatus is independent of the neutralization of electricity and comprises units for respectively carrying out an electrostatic charge process, an exposure process, an image development process, and an image transferring process, which are arranged around the electrophotographic photoconductor, while a unit for an electricity neutralization is eliminated.

In other words, by applying the photoconductor using the predetermined hole-transfer agent and the predetermined additive to an image-forming apparatus equipped with a system independent of the neutralization of electricity, an image-forming apparatus excellent in crack and wear resistances while preventing the generation of exposure memory may be provided. Therefore, the image-forming apparatus may be miniaturized and the number of components in the apparatus may be reduced, thereby allowing a reduction in costs.

DETAILED DESCRIPTION OF THE PREFERRED EMBODIMENTS

First Embodiment

A first embodiment of the present invention is an electrophotographic photoconductor comprising a photosensitive layer containing at least a charge-generating agent, a hole-transfer agent, and a binder resin on a conductive substrate, where the hole-transfer agent has a solubility of 5 to 35% by weight with respect to triglyceride oleate and the photosensitive layer contains a compound represented by the following general formula (1) as an additive.

Hereinafter, a mono-layer type electrophotographic photoconductor as the first embodiment of the present invention will be specifically described.

1. Mono-layer Type Electrophotographic Photoconductor (1) Basic Configuration

Figure 1A:
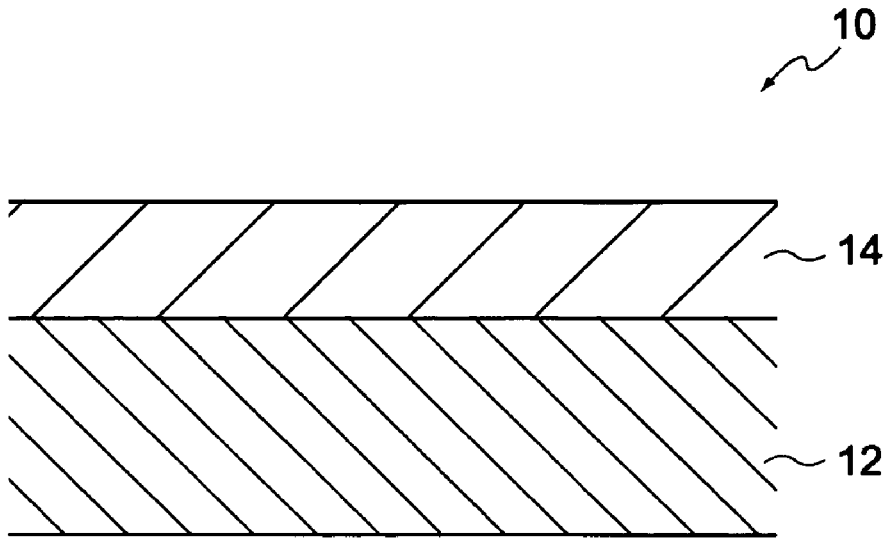
FIG. 1A is a cross sectional view showing a mono-layer type photoconductor in accordance with the present invention.

As shown in FIG. 1A, a mono-layer type electrophotographic photoconductor 10 is constructed of a single photosensitive layer 14 mounted on a conductive substrate 12.

The photosensitive layer 14 may be formed by coating the surface of the conductive substrate 12 with a coating solution and then drying the resulting coat thereon. In this case, the coating solution is prepared by dissolving or dispersing a charge-generating agent, an electron-transfer agent, a hole-transfer agent, a binder resin, and an additive in a predetermined solvent.

Such a mono-layer type photoconductor 10 is applicable to both positively- or negatively-charged types and is configured as a simple layer structure, so that any coating defect may be avoided in the process of forming a photosensitive layer, thereby being excellent in productivity. In addition, there is a little interface between the layers, so that optical characteristics of the photoconductor may be improved.

Figure 1B:
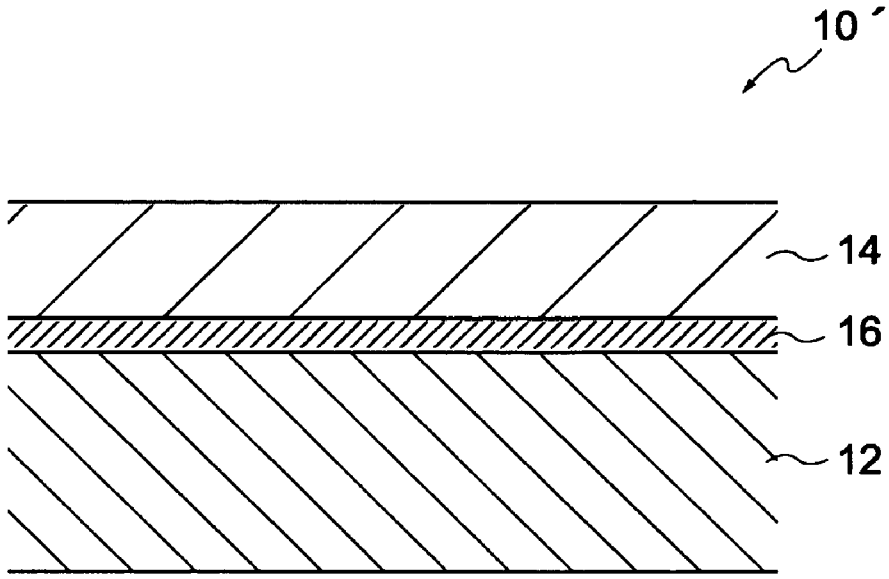
FIG. 1B is a cross sectional view showing a mono-layer type photoconductor in accordance with the present invention.

Alternatively, as shown in FIG. 1B, a mono-layer type photoconductor 10' may be constructed such that an intermediate layer 16 is formed between the photosensitive layer 14 and the conductive substrate 12.

Furthermore, the thickness of the photosensitive layer 14 is typically in the range of 5 to 100 μm, preferably 10 to 50 μm.

(2) Conductive Substrate

The conductive substrate 12 exemplified in each of FIG. 1A and FIG. 1B may be made of any of various materials having conductive properties, which include metals such as iron, aluminum, copper, tin, platinum, silver, vanadium, molybdenum, chrome, cadmium, titanium, nickel, palladium, indium, stainless steel, and brass; plastic materials coated with such metals by vapor deposition or lamination thereof; and glass coated with any of aluminum iodide, tin oxide, and indium oxide.

In addition, a support substrate may be in the form of any shape such as a sheet or a drum as far as the substrate itself or the surface thereof has electrical conductivity. Furthermore, the support substrate may preferably have a sufficient mechanical strength in use. If it is in the form of a drum shape, the conductive substrate may have a diameter of 10 to 60 mm, more preferably 10 to 27 mm in terms of miniaturization.

For preventing the generation of an interference pattern, interference pattern, the surface of the support substrate may preferably be subjected to a roughening treatment using a method of etching, anodic oxidation, wet-blasting, sand-blasting, rough-cutting, centerless-cutting, or the like.

Furthermore, when the anode oxidation or the like is carried out on the conductive substrate, it may become nonconductive or semiconductive property. Even in this case, as far as predetermined effects are obtained, it may be included in the conductive substrates.

(3) Intermediate Layer

Furthermore, as shown in FIG. 1B, an intermediate layer 16 containing a predetermined binder resin may be mounted on the support substrate 12 because of the following reasons:

It improves adhesiveness between the conductive substrate 12 and the photosensitive layer 14 and furthermore the addition of predetermined fine powders to the intermediate layer may prevent the generation of an interference pattern by scattering of incident light. The fine powders include, but not limited as far as having light-scattering or dispersant properties, white pigments such as titanium oxide, zinc oxide, zinc oxide, zinc sulphide, white lead, and lithopone; extender pigments such as alumina, calcium carbonate, and barium sulfate; fluorine resin particles; benzoguanamine resin particles; and styrene resin particles.

Furthermore, it is preferable to define the film thickness of the intermediate layer within a predetermined range because of the following reasons: When the intermediate layer becomes too thick, the surface of the photoconductor tends to generate a residual potential, so that it may become a factor that lowers the electric properties of the photoconductor. On the other hand, when the intermediate layer becomes too thin, the surface irregularity of the photoconductor may not be modified in a sufficient manner, so that the adhesiveness between the support substrate and the photosensitive layer may not be obtained.

Therefore, the intermediate layer may have a film thickness of preferably 0.1 to 50 μm, more preferably 0.5 to 30 μm.

(4) Charge-Generating Agent

Furthermore, the charge-generating agent of the present invention may be any of those known in the art, including: organic photoconductor materials, such as phthalocyanine pigments, for example, metal-free phthalocyanine and oxotitanyl phthalocyanine, perylene pigments, bis-azo pigments, dioketopyrroropyrrole pigments, metal-free naphthalocyanine pigments, metal naphthalocyanine pigments, squaline pigments, triazo pigments, indigo pigments, azlenium pigments, cyanine pigments, pyrimidine pigments, ansanthrone pigments, triphenyl methane pigments, slane pigments, toluidine pigments, pyrazoline pigments, and quinacridon pigments; and inorganic photoconductor materials, such as selenium, selenium-tellurium, selenium-arsenicum, cadmium sulfide, and amorphous silicon may be used.

More concretely, phthalocyanine pigments (CGM-A to CGM-D) represented by the formulae (8) to (11) described below may preferably be used because of the following reasons:

A photoconductor having its sensitivity at a wavelength of 600 to 800 nm or more is required when any of these phthalocyanine pigments is employed in an image-forming apparatus having a digital optical system, such as a laser-beam printer or a facsimile having a semiconductor laser as an optical source.

On the other hand, any of perylene pigments, bisazo pigments, and the like may be preferably used when it is employed in an image-forming apparatus having an analog optical system, such as an electrostatic copying machine equipped with a halogen lamp as a white light source because of a need of a photoconductor having (8)

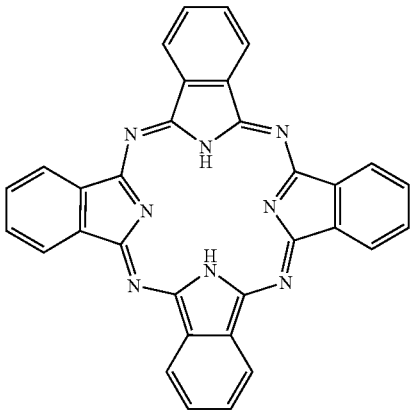

(CGM-A)

(9)

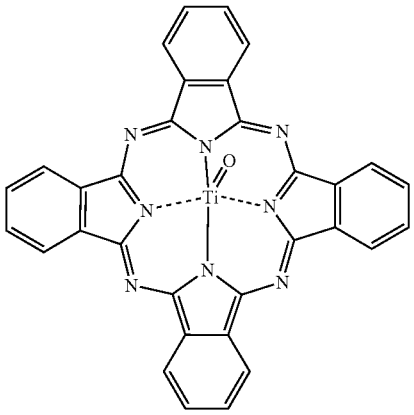

(CGM-B)

-continued (10)

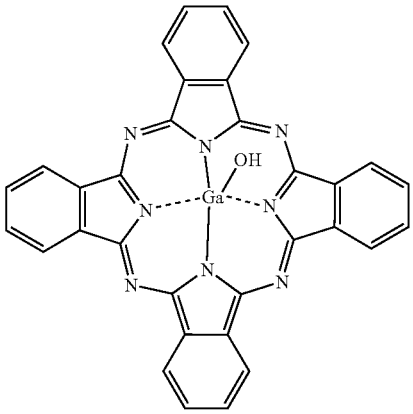

(CGM-C)

(11)

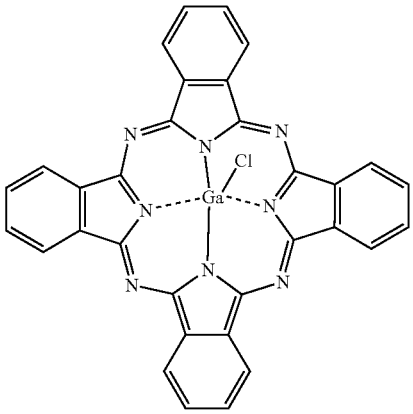

(CGM-D)

(5) Hole-Transfer Agent

Furthermore, the hole-transfer agent (HTM), which may be used in the present invention, is characterized by having a solubility of 5 to 35% by weight (measured at a temperature of 25° C.) in triglyceride oleate because of the following reasons:

When the solubility exceeds 35% by weight, a large amount of the hole-transfer agent may excessively be eluted due to the attachment of a contaminating substance on the surface of the photoconductor. Such a phenomenon leads to the formation of holes in the photosensitive layer, as well as the generation of cracks by stresses caused in the vicinity of the holes, thereby having an adverse effect on image characteristics. In contrast, when the solubility is less than 5% by weight, even though the generation of cracks as described above may be prevented, it may leads to problems that exposure memory tends to occur and the types of the hole-transfer agents, which may be used, are excessively limited, thereby making a material design or the like difficult.

Therefore, the solubility of the hole-transfer agent may be preferably in the range of 10 to 30% by weight, more preferably in the range of 15 to 27% by weight.

Here, the term "solubility in triglyceride oleate (% by weight)" means the amount of a solvent (hole-transfer agent) (g) with reference to 100 g of triglyceride oleate.

Figure 2:
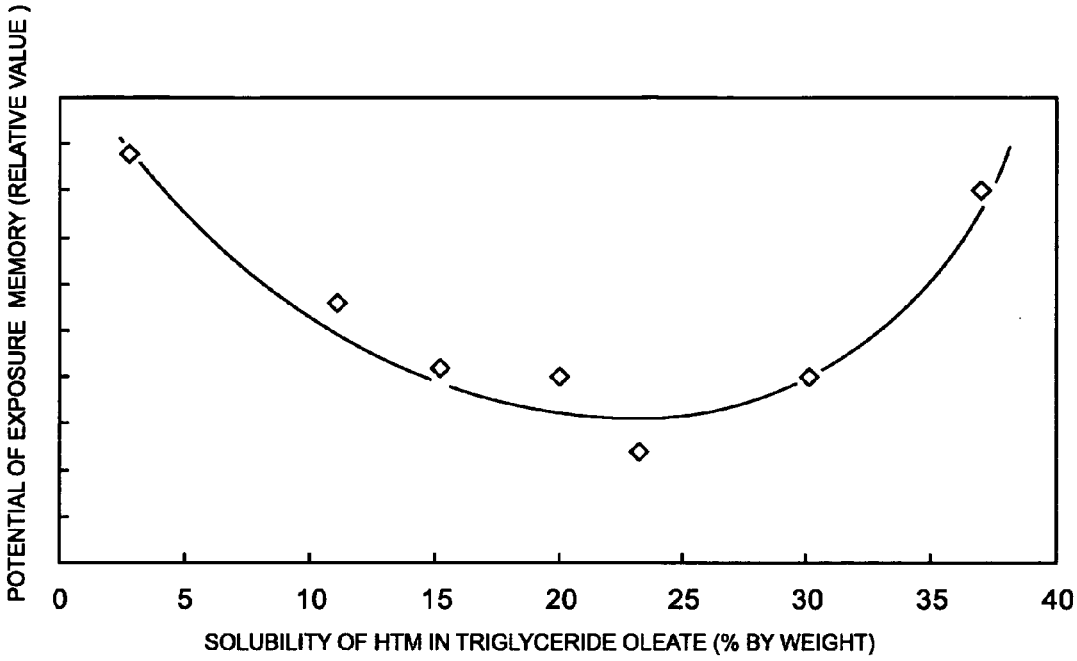
FIG. 2 is a graphical view for explaining the relationship between the solubility of HTM against triglyceride oleate and the exposure memory.

Furthermore, the solubility of the hole-transfer agent in triglyceride oleate has a specific relationship with the generation of exposure memory in the process of forming an image as shown in FIG. 2.

Here, in FIG. 2, there is shown a characteristic diagram where the solubility of the hole-transfer agent in triglyceride oleate (% by weight) is plotted in abscissa, while the residual potential of exposure memory (relative value) on the surface of the photoconductor after carrying out a predetermined process of forming an image is plotted in ordinate.

As is evident from such a characteristic diagram, a quadratic relationship between the solubility of the hole-transfer agent in triglyceride oleate and the potential of exposure memory may be detected.

Therefore, the solubility within the above range may reduce the generation of exposure memory to keep good image characteristics for a long period. Furthermore, any photoconductor having such excellent image characteristics allows a system independent of the neutralization of electricity to be adopted as an image-forming system, thereby leading to the miniaturization of devices.

Figure 3:
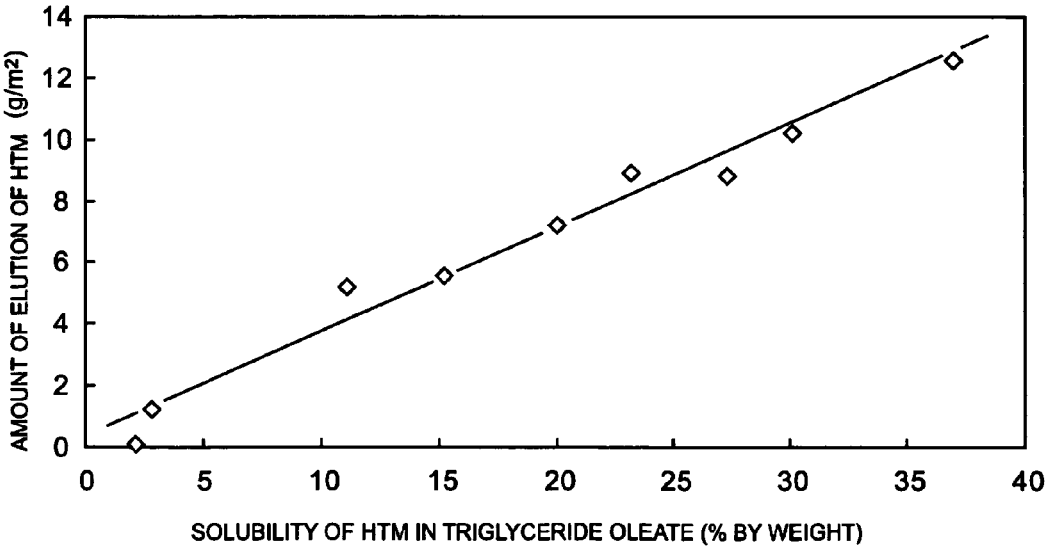
FIG. 3 is a graphical view for explaining the relationship between the solubility of HTM against triglyceride oleate and the amount of HTM eluted.

Referring now to FIG. 3, the relationship between the solubility of the hole-transfer agent in triglyceride oleate and the amount of the elution of the hole-transfer agent from the surface of the electrophotographic photoconductor per unit area.

In FIG. 3, there is shown a characteristic curve where the solubility of the hole-transfer agent in triglyceride oleate (% by weight) is plotted in abscissa, while the amount of elution of the hole-transfer agent from the surface of the electrophotographic photoconductor per unit area ($g/m^2$) when the hole-type photographic photoconductor is immersed in triglyceride oleate for 20 hours is plotted in ordinate.

As is evident from the characteristic curve, the amount of the elution of the hole-transfer agent from the surface of the electrophotographic photoconductor per unit area ($g/m^2$) monotonically increases as the solubility of the hole-transfer agent in triglyceride oleate (% by weight) increases, thereby representing a upward-sloping line.

Therefore, it is appreciated that the amount of the elution of the hole-transfer agent from the surface of the electrophotographic photoconductor per unit area ($g/m^2$) may be defined within a predetermined range by defining the solubility of the hole-transfer agent in triglyceride oleate (% by weight).

Furthermore, the electrophotographic photoconductor used for preparing the above characteristic curve does not employ the additive represented by the general formula (1), so that the amount of the elution of the hole-transfer agent from the surface of the electrophotographic photoconductor per unit area ($g/m^2$) may be of a larger value, compared with one attained by using the additive. In the present invention, however, the additive represented by the general formula (1) is employed, so that the amount of the elution of the hole-transfer agent from the surface of the electrophotographic photoconductor per unit area ($g/m^2$) may be defined within the range of 0.05 to 2 $g/m^2$ as far as the solubility of the hole-transfer agent in triglyceride oleate (% by weight) is in the range of 5 to 35% by weight. Therefore, the generation of a black point in a formed image may be effectively prevented.

Furthermore, the amount of the elution of the hole-transfer agent from the surface of the electrophotographic photoconductor per unit area ($g/m^2$) will be described in detail in the subsequent section and a method for measuring such an amount will be also described in detail in examples.

Figure 4:
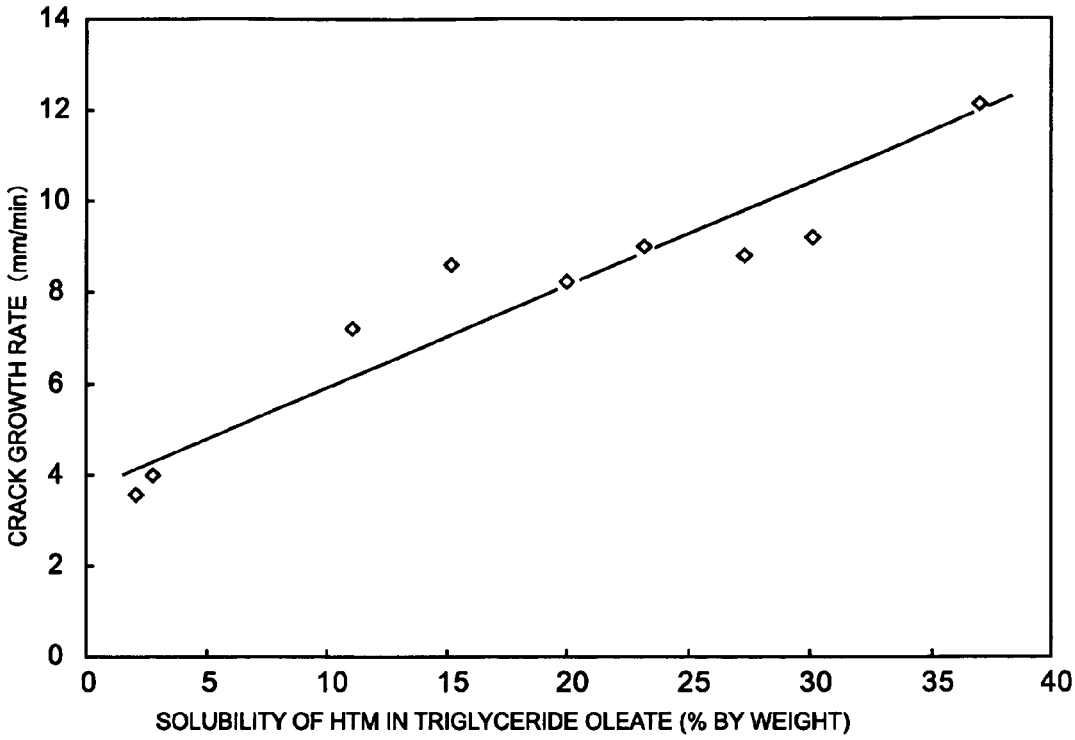
FIG. 4 is a graphical view for explaining the relationship between the solubility of HTM against triglyceride oleate and the crack growth rate.

Referring now to FIG. 4, the relationship between the solubility of the hole-transfer agent in triglyceride oleate and the growth rate of a crack generated on the surface of the photoconductor will be explained, when the electrophotographic photoconductor is immersed in triglyceride oleate.

FIG. 4 represents a characteristic curve where the solubility of the hole-transfer agent in triglyceride oleate (% by weight) is plotted in abscissa and the growth rate of a crack (mm/min) generated on the surface of the photoconductor when the electrophotographic photoconductor is immersed in triglyceride oleate for 120 minutes.

As is evident from the characteristic curve, the growth rate of a crack (mm/min) monotonically increases as the solubility of the hole-transfer agent in triglyceride oleate (% by weight) increases, thereby representing an upward-sloping line.

Therefore, it is appreciated that the growth rate of a crack (mm/min) may be defined within a predetermined range by defining the solubility of the hole-transfer agent in triglyceride oleate (% by weight).

Furthermore, the electrophotographic photoconductor used for preparing the above characteristic curve does not employ the additive represented by the general formula (1), so that the crack growth rate (mm/min) may be of a larger value, compared with one attained by using the additive. In the present invention, however, the additive represented by the general formula (1) is employed, so that the crack growth rate (mm/min) may be defined within the range of 3.5 mm/min or less as far as the solubility of the hole-transfer agent in triglyceride oleate (% by weight) is in the range of 5 to 35% by weight. Therefore, the generation of a black point in a formed image may be effectively prevented.

Furthermore, a method for measuring such a crack growth rate will be also described in detail in examples.

(5)-1 Types

The hole-transfer agent used in the present invention may be any of those including benzidine compounds, phenylene diamine compounds, naphthylene diamine compounds, phenanthrylene diamine compounds, oxadiazole compounds, styryl compounds, carbazole compounds, pyrazoline compounds, hydrazone compounds, triphenyl amine compounds, indole compounds, oxazole compounds, isoxazole compounds, thiazole compounds, thiadiazole compounds, imidazole compounds, pyrazole compounds, triazole compounds, butadiene compounds, pyrene-hydrazone compounds, acrolein compounds, carbazole-hydrazone compounds, chinoline-hydrazone compounds, stilbene compounds, stilbene-hydrazone compounds, and diphenylene diamine compounds, independently or in combinations of two or more of them, but not specifically limited to as far as they satisfy the conditions of the solubility as described above.

(5)-2 Concrete Examples

Furthermore, concrete examples of the hole-transfer agent include compounds (HTM-1 to 7) represented by the following general formulae (12) to (18).

(12)

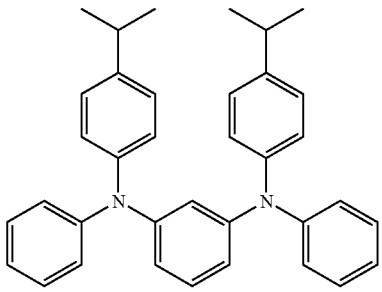

(HTM-1)

-continued (13)

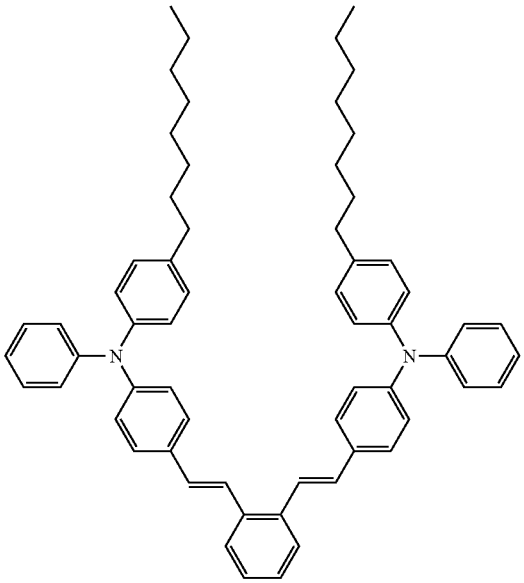

(HTM-2)

(14)

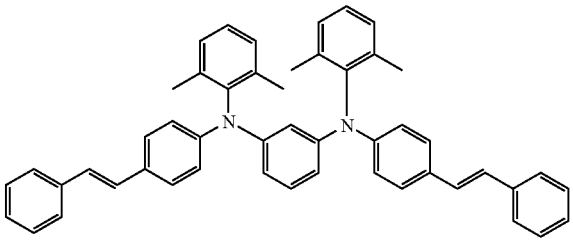

(HTM-3)

(15)

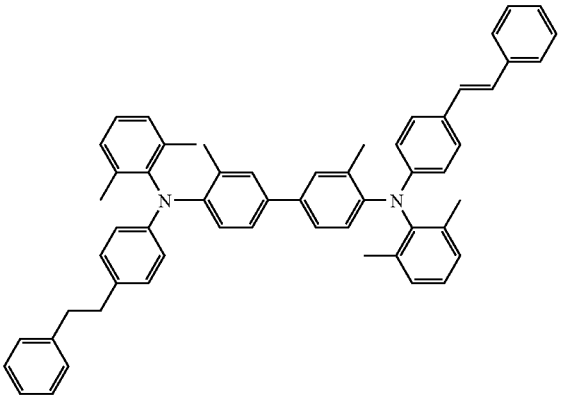

(HTM-4)

-continued (16)

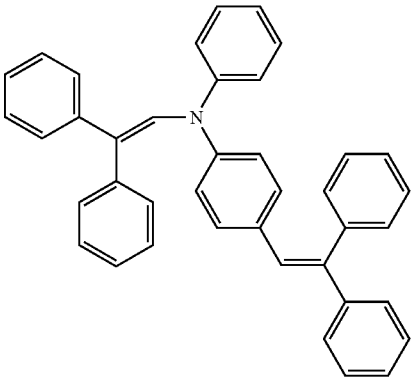

(HTM-5)

(17)

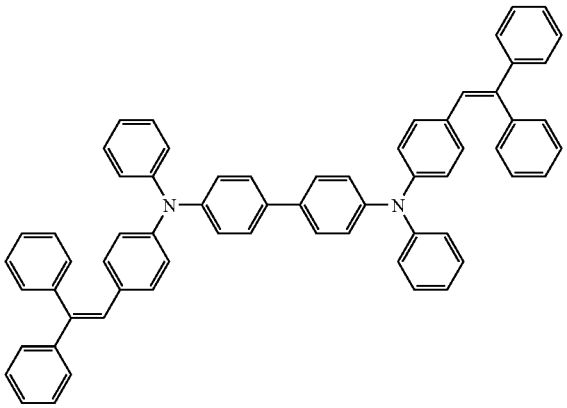

(HTM-6)

(18)

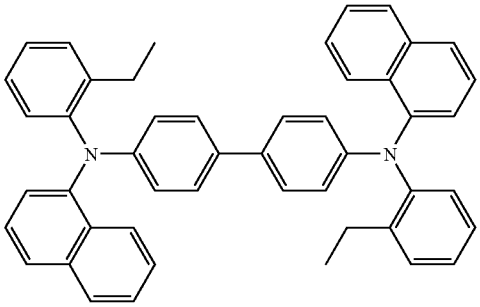

(HTM-7)

(5)-3 Amount Added

Furthermore, the amount of the hole-transfer agent added may be preferably in the range of 1 to 120 parts by weight with respect to 100 parts by weight of the binder resin because of the following reasons:

When the amount of the hole-transfer agent is less than 1 part by weight, the hole-transfer ability of the photosensitive layer may extremely decrease and adversely affect on the image characteristics of the photoconductor.

Furthermore, when the amount of the hole-transfer ability exceeds 120 parts by weight, the dispersibility decreases and tends to be crystallized.

Therefore, the amount of the hole-transfer agent added may be preferably in the range of 5 to 100 parts by weight, more preferably in the range of 10 to 90 parts by weight with respect to 100 parts by weight of the binder resin.

(5)-4 Molecular Weight

Furthermore, the hole-transfer agent may preferably have a molecular weight of 300 to 20,000 because of the following reasons:

When the molecular weight of the hole-transfer agent is less than 300, the hole-transfer agent tends to be eluted due to the attachment of skin or finger oil.

In contrast, when the molecular weight of the hole-transfer agent exceeds 20,000, even though it is prevented from eluting to the skin or finger oil, the dispersibility of such an agent in the photosensitive layer may decrease or the hole-transfer ability of the photosensitive layer may decrease.

Therefore, the molecular weight of the hole-transfer agent may be preferably in the range of 500 to 4,000, more preferably in the range of 500 to 2,500. Furthermore, the molecular weight of the hole-transfer agent may be a value calculated on the basis of the structural formula or a value measured by mass spectrum.

(6) Additive

Furthermore, in the present invention, the photosensitive layer is characterized by containing an additive because of the following reasons:

When a contaminant component is attached on the surface of the photoconductor and a monomer component is eluted to form holes in the photosensitive layer, a local stress is relieved by the action of a compound represented by the general formula (1) as an additive on the holes, thereby preventing the generation of cracks.

Therefore, even in the case of using the hole-transfer agent having the solubility as described above, the generation of cracks may be prevented and the image characteristics of the photoconductor may be kept in a stable manner.

Here, a mechanism of generating cracks when a contaminant substance is attached on the surface of the photoconductor will be described in detail.

At first, when the contaminant substance is attached on the surface of the photoconductor, a monomer component in the photosensitive layer, a charge-transfer agent composed of particularly a hole-transfer agent and an electron-transfer agent may begin to be eluted.

Subsequently, on a trace where the electron-transfer agent was eluted out, it is considered that a hole may be formed in the binder resin of the photosensitive layer and a local stress may be then generated in the vicinity of the hole to generate cracks. In other words, the generation of cracks may be considered as a combination of two phenomena: one in which the monomer component is eluted and the other in which any stress is generated in the vicinity of the hole.

When a mechanism of generating cracks is considered in this way, by taking measures for both the elution of the monomer component as a first step and the generation of stress in the vicinity of holes as a second step, the photoconductor may effectively obtain a crack resistance.

In other words, with respect to the elution of the monomer component, the use of a hole-transfer agent having a predetermined solubility allows the solubility of the contaminant component to be controlled, thereby restricting the amount of the elution of the monomer component.

Furthermore, with respect to any stress in the vicinity of holes, the generation of cracks may be prevented by relieving the generated stress by the addition of a specific additive.

The stress in the vicinity of holes may be more effectively relieved by restricting the type of the additive as well as controlling its molecular weight and the amount added within the predetermined ranges, respectively.

(6)-1 Cconcrete Examples

Furthermore, concrete examples of the additive include compounds (BP-1 to 6) represented by the following general formulae (2) to (7):

(2)

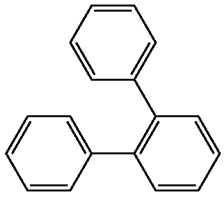

(BP-1)

(3)

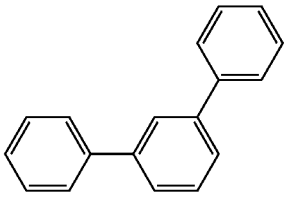

(BP-2)

(4)

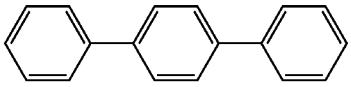

(BP-3)

(5)

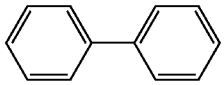

(BP-4)

(6)

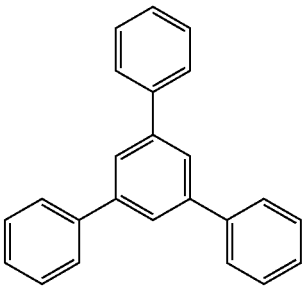

(BP-5)

(7)

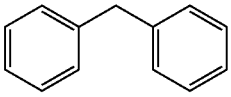

(BP-6)

Furthermore, in addition to the compounds described above, the concrete examples of the additive used in the present invention further include compounds (BP-7 to 24) represented by the general formulae (19) to (36).

(19)
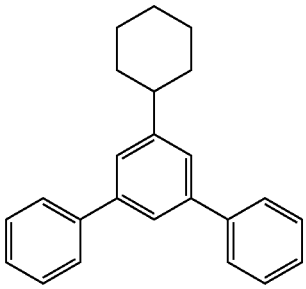
(BP-7)
(20)
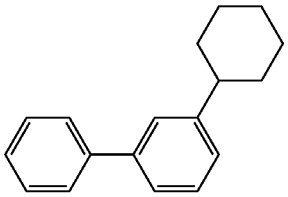
(BP-8)
(21)
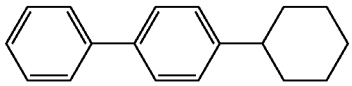
(BP-9)
(22)
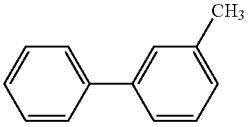
(BP-10)
(23)
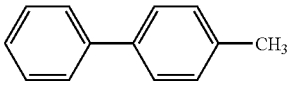
(BP-11)
(24)
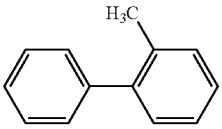
(BP-12)
(25)
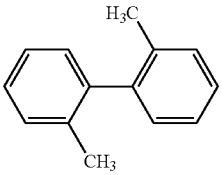
(BP-13)
-continued
(26)
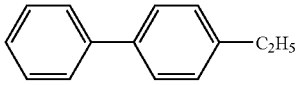
(BP-14)
(27)
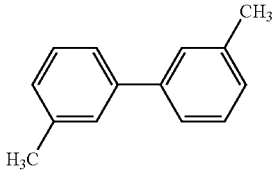
(BP-15)
(28)
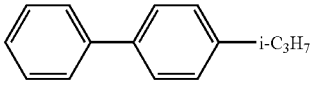
(BP-16)
(29)
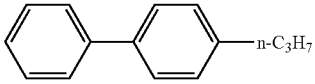
(BP-17)
(30)
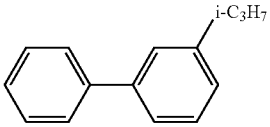
(BP-18)
(31)
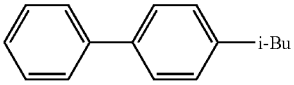
(BP-19)
(32)
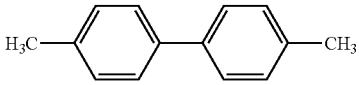
(BP-20)
(33)
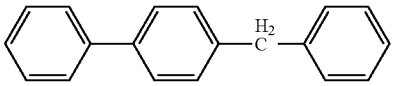
(BP-21)
(34)
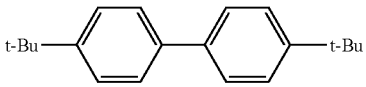
(BP-22)

-continued (35)

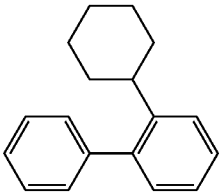

(BP-23)

(36)

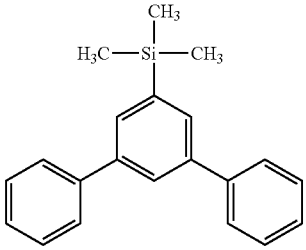

(BP-24)

(6)-2 Amount Added

Furthermore, in the present invention, the amount of the additive added may be preferably in the range of 1.5 to 14% by weight with respect to the solid content of the photosensitive layer because of the following reasons:

When the amount added is less than 1.5% by weight, the additive may not sufficiently exert the action of relieving the stress as described above and the generation of cracks may not be prevented in a sufficient manner.

In contrast, furthermore, the glass transition point (Tg) of the photosensitive layer decreases when the amount added exceeds 14% by weight, so that the wear resistance of the photoconductor may decrease. In addition, the dispersibility of the additive in the binder resin decreases, so that the crystallization of the additive may be observed.

In other words, when the amount of the additive added is defined within such a range, the photosensitive layer may be provided with crack resistance without an increase of molecular weight of the binder resin, thereby obtaining a photoconductor which is also excellent in productivity.

Therefore, the amount of the additive added may be preferably in the range of 2 to 12% by weight, more preferably in the range of 3 to 10% by weight.

Furthermore, the term "solid content of the photosensitive layer" means structural components thereof except for solvents. In the present invention, it means a combination of a charge-generating agent, a charge-transfer agent, a binder resin, and an additive.

(6)-3 Molecular Weight

Furthermore, the additive may preferably have a molecular weight of 150 to 350 because of the following reasons:

When the molecular weight of the additive is less than 150, a stress in the vicinity of holes may not be sufficiently relieved.

In contrast, when the molecular weight exceeds 350, the dispersibility of the additive in the binder resin decreases and the interaction of the additive with holes may insufficiently exert.

Therefore, the molecular weight of the additive may be preferably in the range of 200 to 300, more preferably in the range of 230 to 270.

Furthermore, for example, the molecular weight of the additive may be also calculated on the basis of a structural formula. Alternatively, it may be also measured using a mass spectrum obtained by a mass spectrometer.

(7) Electron-transfer Agent

A electron-transfer agent used in the present invention may include, but not specifically limited to, benzoquinone compounds, naphthoquinione compounds, anthraquinone compounds, diphenoquinone compounds, dinaphthoquinone compounds, naphthalene tetracarbonate dimide compounds, fluorenone compounds, malononitrile compounds, thiopyran compounds, trinitrilothioxanthone compounds, dinitroanthracence compounds, dinitroacridine compounds, nitroanthraquinone compounds, and dinitroanthraquinone compounds, which may be provided independently or in combination of two or more of them.

(7)-1 Concrete Examples

Furthermore, concrete examples of the electron-transfer agent include compounds (ETM-A to F) represented by the general formulae (37) to (42).

(37)

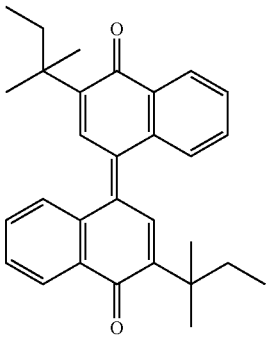

(ETM-A)

(38)

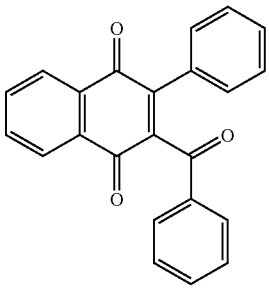

(ETM-B)

(39)

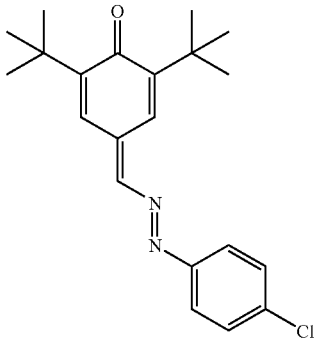

(ETM-C)

-continued (40)

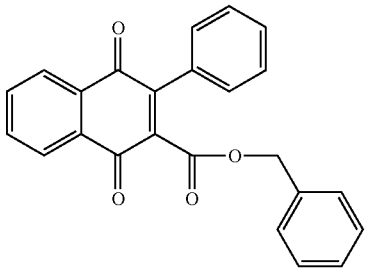

(ETM-D)

(41)

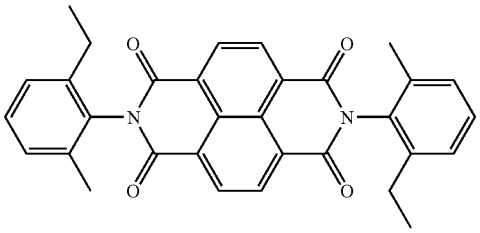

(ETM-E)

(42)

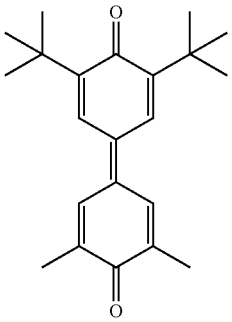

(ETM-F)

(8) Binder Resin (8)-1 Types

The types of the binder resin used for preparing the electrophotographic photoconductor of the present invention may include, but not specifically limited to, thermoplastic resins, such as a polycarbonate resin, a polyester resin, a polyalylate resin, a styrene-butadiene copolymer, styrene-acrylonitrile copolymer, a styrene-maleate copolymer, an acrylic copolymer, a styrene-acrylic copolymer, polyethylene, ethylene-vinylacetate copolymer, a polyethylene chloride, polyvinyl chloride, polypropylene, an ionomer, a vinyl chloride-vinyl acetate copolymer, an alkyd resin, polyamide, polyurethane, polysulfone, a diallyl phthalate resin, a ketone resin, a polyvinyl butyral resin, and a polyether resin; cross-linkable thermosetting resins, such as a silicon resin, an epoxy resin, and a phenol resin, a urea resin, and a melamine resin; and photocurable resins, such as epoxy acrylate and urethane acrylate.

(8)-2 Weight Average Molecular Weight

The weight-average molecular weight of the binder resin may preferably be, but not specifically limited to, in the range of 70000 or less, more preferably in the range of 20000 to 55000 because of the following reasons:

In the present invention, the additive is added to keep its crack resistance, so that the image characteristics of the photoconductor may be retained without lowering both its crack resistance and wear resistance even if a binder resin having a comparatively lower molecular weight. In this case, however, when the molecular weight of the binder resin is too low, the crack resistance may decrease.

Furthermore, the molecular weight of the binder resin may be also calculated on the basis of a structural formula. Alternatively, it may be also measured using a mass spectrum obtained by a mass spectrometer.

(8)-3 Concrete Examples

Furthermore, concrete examples of the binder resin include z-type polycarbonate resins (BD-1) represented by the following general formula (43):

(43)

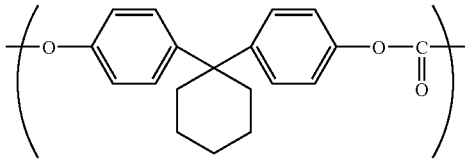

(BD-1)

(9) Characteristics of Photosensitive Layer (9)-1 Amount of the Elution of the Hole-transfer Agent When the electrophotographic photoconductor is immersed in triglyceride oleate for 20 hours, the amount of the elution of the hole-transfer agent from the surface of the electrophotographic photoconductor per unit area may preferably be in the range of 0.05 to 2 g/m$^2$ because of the following reasons:

By defining the amount of the elution of the hole-transfer agent from surface of the electrophotographic photoconductor per unit area under such conditions, a photoconductor, where the generation of cracks may be more positively prevented, may be obtained.

In other words, the hole-transfer agent, which may be used in the present invention, is able to prevent the generation of exposure memory effectively but high in solubility in triglyceride oleate. Thus, a contaminant component from skin or finger oil or the like may facilitate the formation of holes in the photosensitive layer by a contaminant component and tends to become a cause of generating cracks. Therefore, in the present invention, an additive having a specific structure is employed to relief the stress in the vicinity of holes to prevent Furthermore, by defining the amount of the elution of the hole-transfer agent from the surface of the electrophotographic photoconductor per unit area under the conditions of immersing the photoconductor in triglyceride oleate for 20 hours, a substantial degree of preventing the generation of cracks may be quantitatively confirmed.

Figure 5:
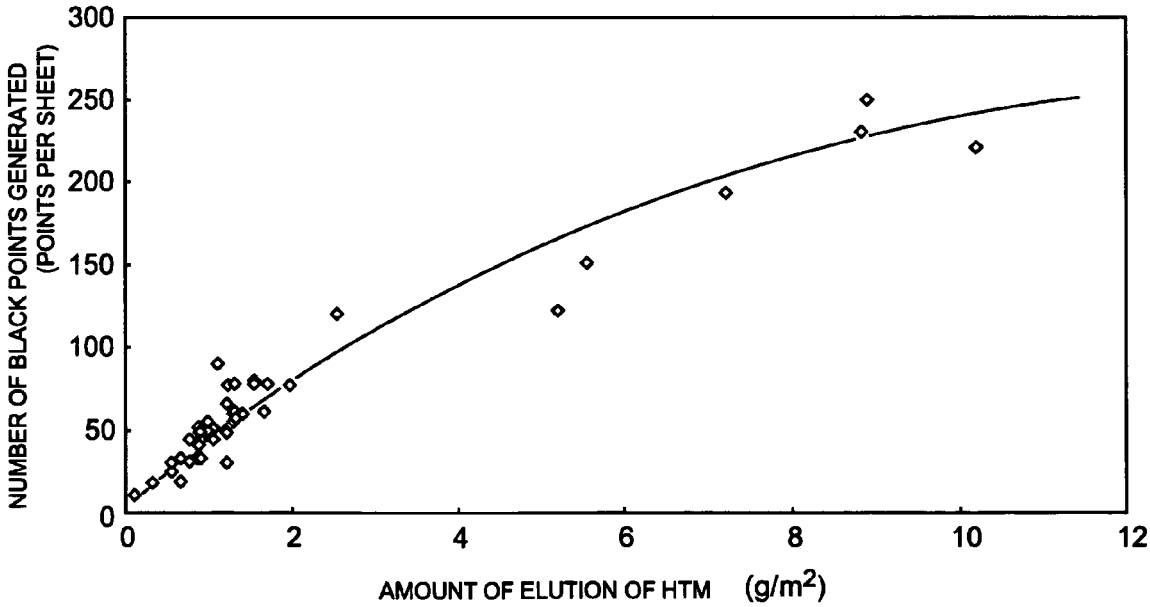
FIG. 5 is a graphical view for explaining the relationship between the amount of HTM eluted out of the surface of the photoconductor and the number of black points generated.

Referring now to FIG. 5, the relationship between the amount of the elution of the hole-transfer agent from the surface of the electrophotographic photoconductor per unit area under the conditions of immersing the photoconductor in triglyceride oleate for 20 hours and the number of black points generated in a formed image. Here, the black points in the formed image are generated due to the presence of clacks.

In FIG. 5, the amount of the elution of the hole-transfer agent from the surface of the electrophotographic photoconductor per unit area (g/m$^2$) unit area under the conditions of immersing the photoconductor in triglyceride oleate for 20 hours is plotted in abscissa, while the number of black points (points per sheet) is plotted in ordinate. As is evident from the characteristic curve, the number of black points (points per sheet) on the formed image increases as the amount of the elution of the hole-transfer agent from the surface of the electrophotographic photoconductor per unit area ($g/m^2$).

More specifically, when the amount of the elution of the hole-transfer agent from the surface of the electrophotographic photoconductor per unit area ($g/m^2$) is in the range of 0.05 to 2 ($g/m^2$), the number of black points (points per sheet) on the formed image may be restricted at 100 points per sheet or less. In addition, when the amount of the elution of the hole-transfer agent from the surface of the electrophotographic photoconductor per unit area ($g/m^2$) exceeds 2 $g/m^2$, the number of black points (points per sheet) generated on the formed image) reaches 100 points per sheet or more, there by recognizing the presence of a defect in the formed image.

Therefore, the amount of the elution of the hole-transfer agent from the surface of the electrophotographic photoconductor per unit area under the conditions of immersing the photoconductor in triglyceride oleate for 20 hours is preferably in the range of 0.05 to 1.5 $g/m^2$, more preferably in the range of 0.05 to 1 $g/m^2$.

Furthermore, methods for determining the amount of the elution of the hole-transfer agent from the surface of the electrophotographic photoconductor per unit area and the number of black points generated will be described in examples below, respectively.

(9)-2 Glass Transition Point

Furthermore, the photosensitive layer may preferably have a glass transition point (Tg) of 60° C. or more because of the following reasons:

When the additive is added as described above, the glass transition point (Tg) of the photosensitive layer varies and affects on the wear resistance of the photoconductor.

In other words, if the grass transition point (Tg) is less than a predetermined value by adding an excess amount of the additive, the pressure resistance of the photoconductor may decrease, and the image characteristics of the photoconductor may be adversely affected in repetitive use. In contrast, when the glass transition point (Tg) rises too much, the surface of the photoconductor stiffens excessively and tends to generate cracks.

Therefore, the glass transition point (Tg) may be preferably in the range of 60 to 90° C., more preferably in the range of 65 to 80° C.

Furthermore, the glass transition point (Tg) may be obtained from a changing point of specific heat by defining an absorption curve using a differential scanning calorimeter (DSC-6200, manufactured by Seiko Instruments Inc.) as a measuring device.

More specifically, 10 mg of a measurement sample consisting of materials that makes up a photoconductor: a charge-generation agent, an electron-transfer agent, a hole-transfer agent, an additive, and a binder resin, is placed in an aluminum pan. In addition, as a reference, an empty aluminum pan is used. The measurement is carried out under the conditions that a measurement temperature range of 25 to 200° C. and a temperature-rising rate of 10° C./min at normal temperature and humidity. Subsequently, the glass transition point (Tg) may be obtained from the resulting endothermic curve.

(10) Manufacturing Method

A method for manufacturing a mono-layer type electrophotographic photoconductor may be performed by the procedures described below but not specifically limited to such procedures.

At first, a coating solution is prepared as a dispersion solution by adding a charge-generating agent, a charge-transfer agent, a binder resin, an additive, and so on to a solvent. The coating solution thus obtained is applied on an electrically-conductive substrate (a tube made of aluminum) by any of coating method, such as a dip-coating method, a spray-coating method, a bead-coating method, a blade-coating method, and a roll-coating method.

Subsequently, for example, the coated substrate is subjected to hot-air drying at 100° C. for 30 minutes, thereby obtaining a mono-layer type electrophotographic photoconductor having a photosensitive layer with a predetermined film thickness.

The solvent used for preparing such a dispersion solution may be any of organic solvents including alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethyleneglycol dimethylether, diethyleneglycol methylether, 1,3-dioxolane, and 1,4-dioxane; ketones such as acetone, methylethyl ketone, and cyclohexanone; esters such as ethyl acetate and methyl acetate; and dimethyl formaldehyde, dimethyl formamide, and dimethyl sulfoxide. These solvents may be used independently or in combination of two or more of them.

Furthermore, for improving the dispersibility of the charge-generating agent and the smoothness of the photoconductor's surface, a surfactant, a leveling agent, or the like may be added.

Furthermore, prior to the formation of such a photosensitive layer, an intermediate layer may be formed on the conductive substrate.

For forming the intermediate layer, a binder resin and optionally an additive (organic or inorganic fine powders) may be dispersed and mixed with an appropriate dispersion medium using a known method such as a roll mill, a ball mill, an attriter, a paint shaker, or an ultrasonic dispenser to prepare a coating solution. Then, the resulting coating solution is applied on the substrate by a known method such as a spray method, a dipping method, or a spraying method, and then subjected to a thermal treatment to form an intermediate layer.

In addition, in small amounts of various additives (organic or inorganic fine powders) may be added for preventing the generation of an interference pattern by causing light scattering as far as the amounts thereof are within the range that dos not cause sedimentation or the like in production. Subsequently, in accordance with a manufacturing method the coating solution thus obtained may be applied on, for example, a support substrate (a tube made of aluminum) by any of coating methods such as dip-coating method, a spraying coating method, a bead-coating method, a blade-coating method, and a roll-coating method.

After that, the step for drying the coating solution on the support substrate may preferably be carried out at a temperature of 20 to 200° C. for 5 minutes to 2 hours.

The solvent used for preparing such a coating solution may be any of organic solvents including alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ketones such as acetone, methylethyl ketone, and cyclohexanone; esters such as ethyl acetate and methyl acetate; and dimethyl formaldehyde, dimethyl formamide, and dimethyl sulfoxide. These solvents may be used independently or in combination of two or more of them.

2. Multi-layer Type Photoconductor

Figure 6A:
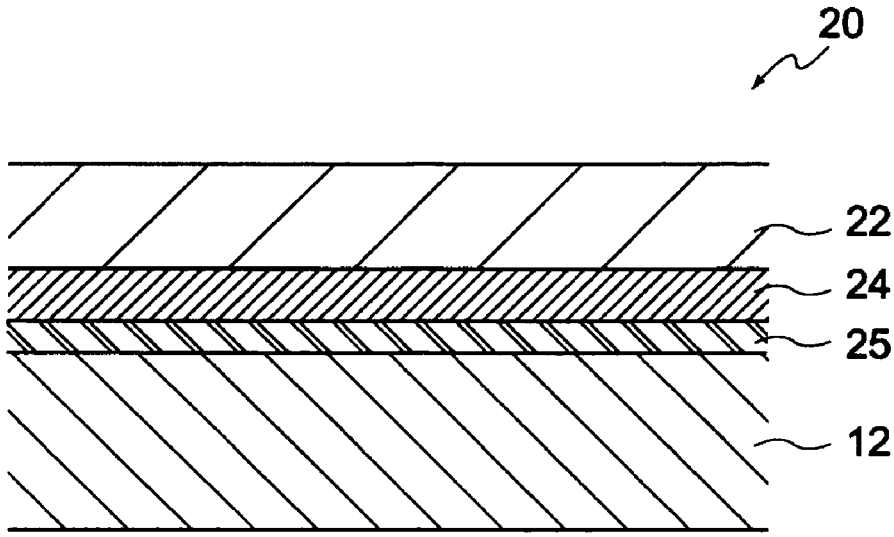
FIG. 6A is a cross-sectional view showing a multi-layer type photoconductor in accordance with the present invention.

As the electrophotographic photoconductor for wet-developing of the present invention, a laminated type electrophotographic photoconductor as shown in each of FIG. 6A may be also preferably used. The multi-layer type photoconductor 20 may be prepared by forming a charge-generating layer 24 containing a charge-generating agent on a substrate 12 by means of deposition, coating, or the like and then applying both a charge-transfer agent and a binder resin on the charge-generating layer 24, followed by drying to form a charge-transfer layer 22.

Figure 6B:
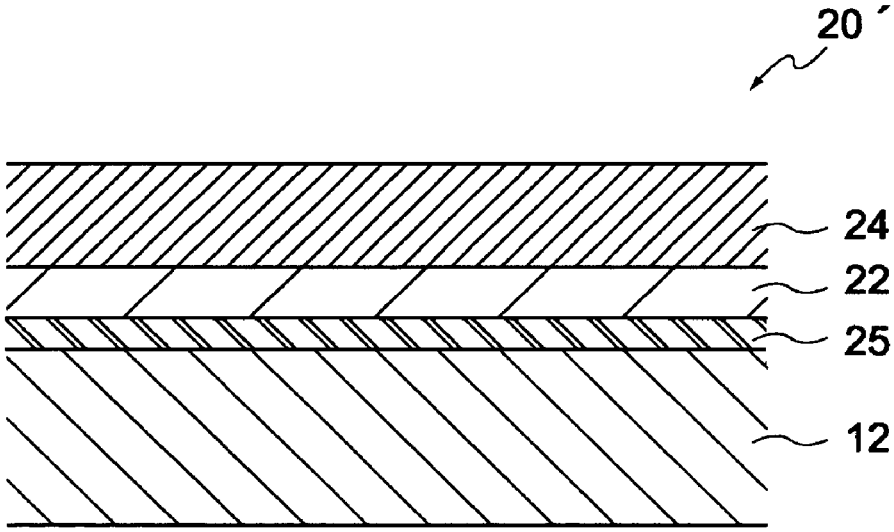
FIG. 6B is a cross-sectional view showing a multi-layer type photoconductor in accordance with the present invention.

Furthermore, as shown in FIG. 6B, in contrast to the structure described above, a charge-transfer layer 22 may be formed on a substrate 12 at first and a charge-generating layer 24 may be then formed thereon. In this case, however, the charge-generating layer 24 is thinner than the charge-transfer layer 22, so that it is more preferable to form the charge-transfer layer 22 on the charge-generation layer 24 as sown in FIG. 6A.

Furthermore, just as in the case with the mono-layer type photoconductor, it is also preferable to form an intermediate layer 25 on the conductive substrate 12.

Both a coating solution for forming a charge-generating layer and a coating solution for forming a charge-transfer layer may be prepared by, for example, dispersing and mixing predetermined components such as a charge-generating agent, a charge-transfer agent, and a binder resin with a dispersion medium by a roll mill, a ball mill, an attritor, a paint shaker, an ultrasonic dispersing device, respectively.

Furthermore, the amount of the charge-generating agent added may be preferably in the range of 5 to 1000 parts by weight more preferably in the range of 30 to 500 parts by weight with respect to 100 parts by weight of the binder resin in the charge-generating layer. Furthermore, the amount of the charge-transfer agent added may be preferably in the range of 20 to 500 parts by weight, more preferably in the range of 30 to 200 parts by weight with respect to 100 parts by weight of the binder resin in the charge-generating layer.

Furthermore, even in the case of such a multi-layer type photoconductor, an electron-transfer agent may be used as a charge-transfer agent together with a hole-transfer agent.

For the multi-layer type photosensitive layer 20, furthermore, the thickness thereof itself is not specifically limited, but the charge-generating layer therein may preferably have a thickness of 0.01 to 5 μm, preferably 0.1 to 3 μm.

Furthermore, it is preferable to prepare the charge-transfer layer in a thickness of 2 to 100 μm, more preferably 5 to 50 μm.

Second Embodiment

A second embodiment of the present invention is an image-forming apparatus that comprises an electrophotographic photoconductor of the first embodiment and an electrification device for carrying out an electrostatic charge process, an exposure light source for carrying out an exposure process, a developing device for carrying out an image development process, and a transfer device for carrying out an image-transferring process, which are arranged around the electrophotographic photoconductor. In addition, such an image-forming apparatus has no unit for electricity neutralization.

Furthermore, in the following description for the image-forming apparatus, it will be described with reference to an example that uses a mono-layer type photoconductor as an electrophotographic photoconductor.

Figure 7:
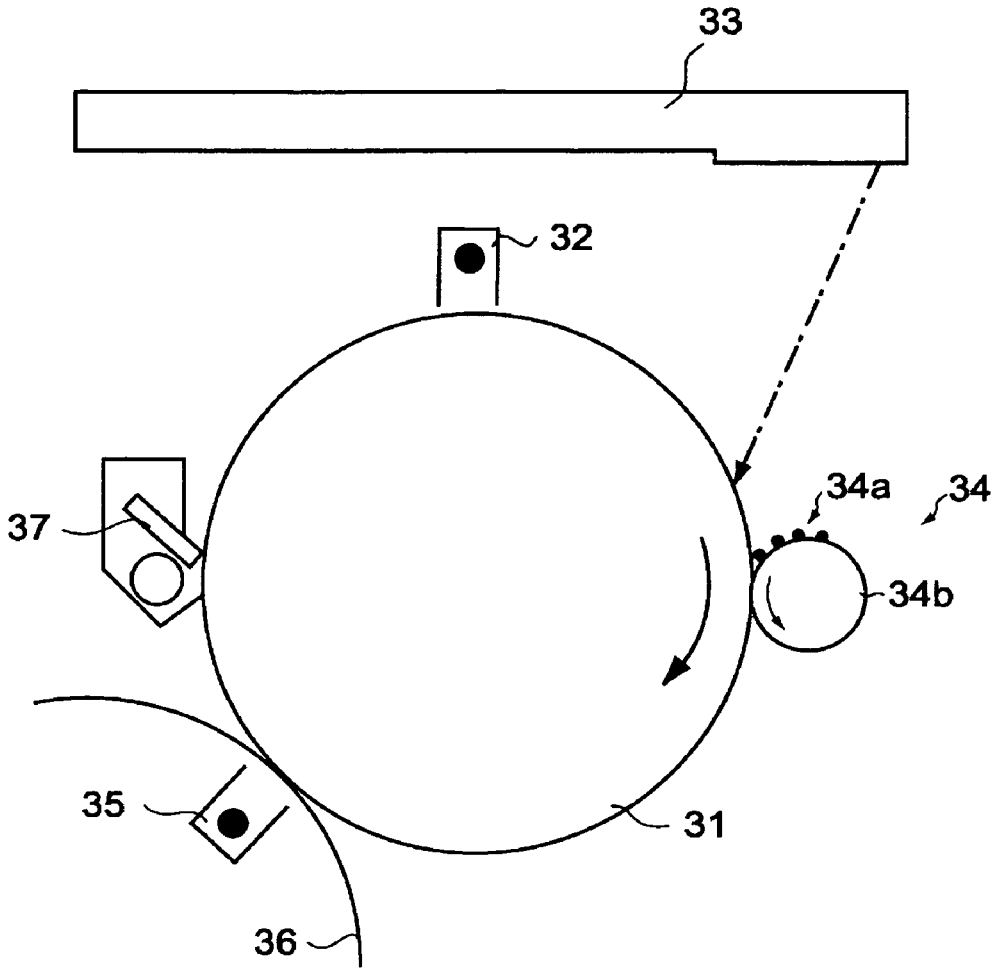
FIG. 7 is a schematic view of an example of an image-forming apparatus in accordance with the present invention.

As shown in FIG. 7, around an electrophotographic photoconductor 31, an electrification device 32 for carrying out an electrostatic charge process, an exposure light source 33 for carrying out an exposure process, a developing device 34 for carrying out an image development process, and a transfer device 35 for carrying out an image transferring process are sequentially arranged.

In addition, the photoconductor 31 turns at constant speed in the direction of the arrow. On the surface of the photoconductor 31, an electrophotographic process is carried out by the following sequential steps: More specifically, the whole surface of the photoconductor 31 is charged by the electrification device 32. Then, a print pattern is exposed by the exposure light source 33.

Subsequently, the developing device 34 carries out a toner development corresponding to the print pattern. Furthermore, the transfer device 35 carries out toner transfer on a transfer material (paper) 36.

Here, a developer 34 a, in which the toner is dispersed, is transferred by a developing roller 34*b* and a predetermined developing vias is then applied to allow the toner to be attracted on the surface of the photoconductor 31, thereby developing a toner image on the photoconductor 31.

In other words, when the electrophotographic photoconductor of the present invention is used as the photoconductor 31, the tendency of generating cracks due to a contaminant component may be improved and the generation of exposure memory may be prevented for a long period. Therefore, an image-forming apparatus in which a unit for an electricity neutralization is eliminated, may be employed.

EXAMPLES

Hereinafter, the present invention will be described in detail with reference to examples. However, the present invention is not limited to the contents of these examples.

Example 1

1. Manufacture of Electrophotographic Photoconductor

A coating solution for preparing a photosensitive layer was prepared by dispersing and mixing 4 parts by weight of an X-type metal-free phthalocyanine (CGM-A) represented by the general formula (8) as a charge-generating agent; 50 parts by weight of a compound (HTM-1) represented by the general formula (12); 30 parts by weight of a compound (ETM-A) represented by the general formula (37) as a electron-transfer agent; 100 parts by weight of a Z-type polycarbonate resin (BD-1) (weight-average molecular weight: 35000) represented by the general formula (43) as a binder resin; and 4.5 parts by weight of a compound (BD-2) represented by the general formula (3) as an additive together with 800 parts by weight of tetrahydrofuran by means of a ball mill for 50 hours.

Next, the coating solution thus obtained was applied on two cylindrical aluminum tubes (one of 30 mm in diameter and 254 mm in length and the other of 16 mm in diameter and 254 mm in length) and then dried with hot air at 100° C. for 40 minutes, respectively. Consequently, two different mono-layer type electrophotographic photoconductors having 30 μm in film thickness were obtained.

By the way, the evaluation of the number of generated black points was carried out on the mono-layer type electrophotographic photoconductor using the aluminum tube of 16 mm in diameter and 254 mm in length. For other evaluations, the mono-layer type electrophotographic photoconductor using the aluminum tube of 30 mm in diameter and 254 mm in length was employed.

2. Evaluation (1) Amount of the Elution of the Hole-transfer Agent

The electrophotographic photoconductor obtained as described above was immersed in triglyceride oleate and the amount of the elution of the hole-transfer agent from the surface of the electrophotographic photoconductor was then evaluated.

In other words, the electrophotographic photoconductor obtained was immersed in triglyceride oleate for 20 hours at room temperature in dark in a discharge system. Subsequently, the UV absorbance of the triglyceride oleate was measured after immersing for 20 hours. Then, a previously-formed standard curve (the concentration of the hole-transfer agent and the UV absorbance) was used to determine the whole amount of the elution of the hole-transfer agent into the triglyceride oleate. Furthermore, the whole-eluting amount obtained was divided by the surface area of the photoconductor, thereby defining the resulting value as the amount of the hole-transfer agent eluted.

(2) Evaluation of Crack Resistance

The electrophotographic photoconductor obtained as described above was immersed in triglyceride oleate for 120 minutes at 20° C. and at a humidity of 60%. Subsequently, cracks generated on the surface of the photoconductor was measured and then evaluated as a crack growth rate (mm/min).

In other words, the surface of the photosensitive layer was observed using an optical microscope and the total length (mm) of the cracks generated was then divided by a immersing time period of 120 (min). The resulting value was defined as a crack growth rate and then evaluated on the basis of the following criteria:

++: less than 2 (mm/min) in crack growth rate;

+: 2 or more but less than 4 (mm/min) in crack growth rate;

±: 4 or more but less than 5 (mm/min) in crack growth rate; and

NA (not available): 5 (mm/min) or more in crack growth rate.

(3) Evaluation of Number of Black Points

Furthermore, evaluation was carried out on the number of black points generated when an image formation was carried out using the electrophotographic photoconductor obtained as described above.

In other words, the electrophotographic photoconductor obtained as described above was mounted on a printer (DP-5600, manufactured by KYOCERA MITA CORPORATION) with the neutralization of a cleaning device and 5000 sheets were then printed under the conditions of high temperature and high humidity (40° C., 90% RH). Subsequently, the printer was left standing for 6 hours under the conditions of high temperature and high humidity and white-background printing was then carried out on a sheet of A4-sized paper, followed by counting and evaluating the number of black points generated (points per sheet) in accordance with the following criteria. The results obtained are listed in Table 1. Here, evaluation criteria were defined in consideration that an evaluation test employed herein was a compulsory test under harsh environment.

++: 30 (points per sheet) or less in number of black points generated;

+: 31 to 50 (points per sheet) in number of black points generated;

±: 51 to 100 (points per sheet) in number of black points generated;

NA (not available): 101 (points per sheet) or more in number of black points generated.

(4) Evaluation of Exposure Memory Potential

The potential of exposure memory on the electrophotographic photoconductor obtained as described above was evaluated.

In other words, the obtained electrophotographic photoconductor was mounted on a multi-function printer (Antico40, manufactured by KYOCERA MITA CORPORATION). A surface potential of an unexposed portion and a surface potential of an exposed portion after carrying out an electrostatic charge process were measured. The difference between these surface potentials was defined as a potential of exposure memory and then evaluated on the basis of the following criteria. The results thus obtained are listed in Table 1.

++: less than 50 (V) in memory potential;

+: 50 or more but less than 90 (V) in memory potential;

±: 90 or more but less than 100 (V) in memory potential; and

NA (not available): 100 (V) or more in memory potential.

(5) Evaluation of Memory Image

Furthermore, evaluation was carried out on a memory image obtained when an image formation was carried out using the electrophotographic photoconductor obtained as described above.

Figure 8:
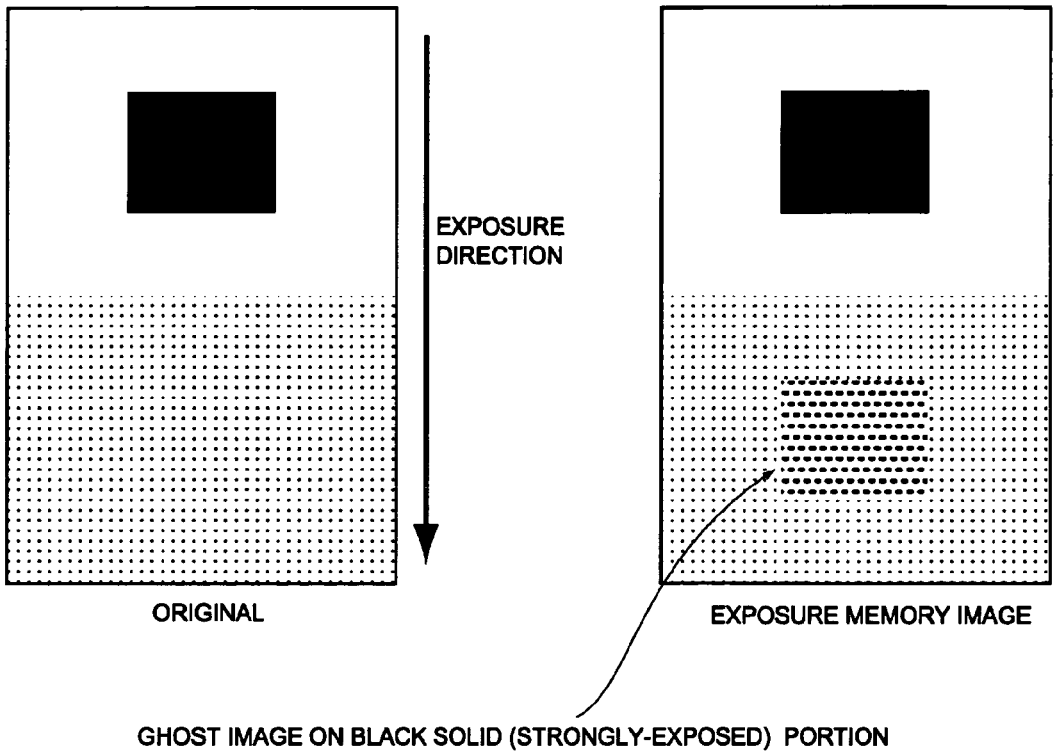
FIG. 8 is a view for explaining a memory image.

In other words, a printing test was carried out under the same conditions as the above conditions for evaluating the potential of exposure memory and a visual observation was then carried out to determine whether the generation of an exposure memory image occurred or not, followed by evaluating the following criteria. Here, the term "exposure memory image" represents an image having a ghost image of an exposure portion occurred on a gray portion due to an increase in surface potential of the photoconductor at a strong exposure portion (black solid portion) when the printing test was carried out using an original as shown in FIG. 8. The results obtained are listed in Table 1.

++: No memory image was observed;

+: Memory image was observed a little;

±: Memory image was observed; and

NA (not available): Memory image was remarkably observed.

(6) Measurement of Glass Transition Point (Tg)

Furthermore, the glass transition point (Tg) of a photoconductor was determined using a differential scanning calorimeter (DSC) with respect to materials that made up the photoconductor.

In other words, 10 mg of a measurement sample (photosensitive layer) consisting of the materials that made up the photoconductor: a charge-generating agent, an electron-transfer agent, a hole-transfer agent, an additive, and binder resin was placed in an aluminum pan and then provided as a sample for the measurement.

In addition, as a reference, an empty aluminum pan was prepared as a standard sample.

Both the measurement sample and the standard sample were subjected to the measurements of endothermic curves using a differential scanning calorimeter (DSC-6200, manufactured by Seiko Instruments Inc.) at normal temperature and normal humidity under the conditions of a measurement temperature range of 25 to 200° C. and a temperature-increasing rate of 10° C./min to obtain the glass transition point (Tg) of the sample, followed by evaluation on the basis of the following criteria. The results obtained are listed in Table 1.

+: 55° C. or more in glass transition point (Tg); and

NA (not available): less than 55° C. in glass transition point (Tg).

(7) Evaluation of Mechanical Durability (Member Resistance)

Furthermore, the mechanical durability (member resistance) of the electrophotographic photoconductor obtained as described above was evaluated.

That is, the electrophotographic photoconductor thus obtained was attached on a drum unit and then left standing for 10 days at a temperature of 50° C. and a humidity of 80% RH. After being left standing, a gray image was printed out and a line represented on the image due to a trace of pressure contact of a member (transfer roller) was then evaluated on the basis of the following criteria:

+: The generation of a line can not be confirmed; and

NA (not available): The generation of a line is confirmed.

Examples 2 to 6

In Examples 2 to 6, as shown in Table 1, electrophotographic photoconductors were manufactured and then evaluated by the same way as that of Example 1, except that the types of the hole-transfer agent were replaced with compounds (HTM-2 to 3 and 5 to 7) represented by the respective formulae (13) to (14) and (16) to (18), respectively. The results obtained are listed in Table 1.

Examples 7 to 11

In Examples 7 to 11, as shown in Table 1, the type of the hole-transfer agent was a compound (HTM-4) represented by the general formula (15) and the contents of their respective additives were then set to 2.5, 4.5, 14, 6, and 15.1 by parts by weight with respect to 100 parts by weight of the binder resin. The results thus obtained are listed in Table 1.

Example 12

In Example 12, as shown in Table 1, an electrophotographic photoconductor was manufactured and then evaluated by the same way as that of Example 1, except for the follows: The type of the hole-transfer agent was a compound (HTM-5) represented by the general formula (16), the type of the additive was then defined as a compound (BP-3) represented by the general formula (4), and the amount of the additive added was 6 parts by weight with respect to 100 parts by weight of the binder resin. The results obtained are listed in Table 1.

Examples 13 to 15

In Examples 13 to 15, as shown in Table 1, electrophotographic photoconductors were manufactured and then evaluated by the same way as that of Example 1, except for the follows:

the type of the hole-transfer agent was a compound (HTM-6) represented by the general formula (17), the types of the additive were compounds (BP-4 to 6) represented by the general formulae (5) to (7), respectively, and the contents of their respective additives were 5 parts by weight with respect to 100 parts by weight of the binder resin. The results obtained are listed in Table 1.

Example 16

In Example 16, as shown in Table 1, an electrophotographic photoconductor was manufactured and then evaluated by the same way as that of Example 1, except for the follows:

the type of the hole-transfer agent was a compound (HTM-2) represented by the general formula (13), the type of the additive was a compound (BP-1) represented by the general formula (2), and the content of the additives was 11 parts by weight with respect to 100 parts by weight of the binder resin. The results obtained are listed in Table 1.

Comparative Example 1

In Comparative Example 1, as shown in Table 1, an electrophotographic photoconductor was manufactured and then evaluated by the same way as that of Example 1, except for the follows:

the type of the hole-transfer agent was a compound (HTM-8) represented by the general formula (44) described below, the type of the additive was a compound (BP-7) represented by the general formula (19), and the content of the additives was 0.5 parts by weight with respect to 100 parts by weight of the binder resin. The results obtained are listed in Table 1.

(44)

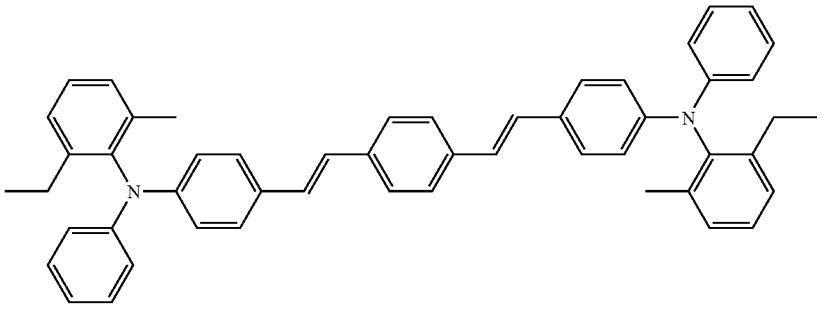

(HTM-8)

Comparative Example 2

In Comparative Example 2, as shown in Table 1, an electrophotographic photoconductor was manufactured and then evaluated by the same way as that of Example 1, except for the follows:

the type of the hole-transfer agent was a compound (HTM-9) represented by the general formula (45) described below and the content of the additives was 15.1 parts by weight of with respect to 100 parts by weight of the binder resin. The results obtained are listed in Table 1.

(45)

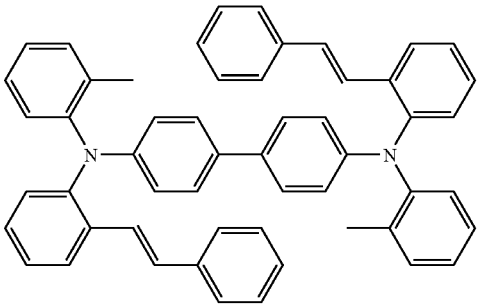

(HTM-9)

Comparative Examples 3 to 9

In Comparative Examples 3 to 9, as shown in Table 1, electrophotographic photoconductors were manufactured and then evaluated by the same way as that of Example 1, except for the follows:

the types of the hole-transfer agent were compounds (HTM-1 to 6 and 9) represented by the general formulae (12) to (17) and (45) described below and no additive was added. The results obtained are listed in Table 1.

Comparative Example 10

In Comparative Example 10, as shown in Table 1, an electrophotographic photoconductor was manufactured and then evaluated by the same way as that of Example 1, except for the follows:

the type of the hole-transfer agent was a compound (HTM-10) represented by the general formula (46) described below and no additive was added. The results obtained are listed in Table 1.

(46)

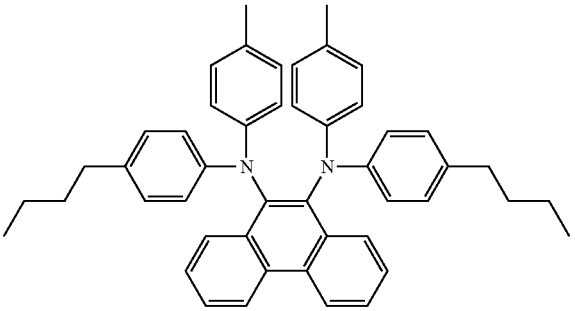

(HTM-10)

TABLE 1

Table 1

| | HTM | | | Additive | | Crack resistance | | Number of black points | |
|---|---|---|---|---|---|---|---|---|---|
| | Type | Solubility (w %) | Amount of elution ($g/m^2$) | Type | Content (parts by weight) | Growth rate (mm/min) | Result | Points generated (points/sheet) | Result |
| Example 1 | HTM-1 | 11.1 | 0.55 | BP-2 | 4.5 | 1.20 | ++ | 25 | ++ |
| Example 2 | HTM-2 | 27.3 | 1.30 | BP-2 | 4.5 | 2.81 | + | 55 | ± |
| Example 3 | HTM-3 | 15.2 | 0.90 | BP-2 | 4.5 | 0.88 | ++ | 48 | + |
| Example 4 | HTM-5 | 30.1 | 1.41 | BP-2 | 4.5 | 2.36 | + | 60 | ± |
| Example 5 | HTM-6 | 20.0 | 1.01 | BP-2 | 4.5 | 1.42 | ++ | 48 | + |
| Example 6 | HTM-7 | 5.0 | 0.55 | BP-2 | 4.5 | 1.85 | ++ | 30 | ++ |
| Example 7 | HTM-4 | 23.2 | 1.98 | BP-2 | 2.5 | 3.50 | + | 77 | ± |
| Example 8 | HTM-4 | 23.2 | 1.21 | BP-2 | 4.5 | 1.23 | ++ | 50 | + |
| Example 9 | HTM-4 | 23.2 | 0.91 | BP-2 | 14.0 | 0.92 | ++ | 44 | + |
| Example 10 | HTM-4 | 23.2 | 0.88 | BP-2 | 6.0 | 1.18 | ++ | 41 | + |
| Example 11 | HTM-4 | 23.2 | 0.91 | BP-2 | 15.1 | 0.85 | ++ | 33 | + |
| Example 12 | HTM-5 | 30.1 | 0.87 | BP-3 | 6.0 | 2.12 | + | 33 | + |
| Example 13 | HTM-6 | 20.0 | 1.55 | BP-4 | 5.0 | 0.58 | ++ | 80 | ± |
| Example 14 | HTM-6 | 20.0 | 1.23 | BP-5 | 5.0 | 0.55 | ++ | 77 | ± |
| Example 15 | HTM-6 | 20.0 | 1.71 | BP-6 | 5.0 | 0.53 | ++ | 78 | ± |
| Example 16 | HTM-2 | 27.3 | 0.66 | BP-1 | 11.0 | 2.40 | + | 19 | ++ |
| Comparative Example 1 | HTM-8 | 2.1 | 0.11 | BP-7 | 0.5 | 3.56 | + | 11 | ++ |
| Comparative Example 2 | HTM-9 | 37.0 | 2.55 | BP-2 | 15.1 | 4.25 | ± | 120 | NA |
| Comparative Example 3 | HTM-1 | 11.1 | 5.2 | Abs. | — | 7.22 | NA | 122 | NA |

TABLE 1-continued

Table 1

| | | | | | | | | | |
|---|---|---|---|---|---|---|---|---|---|
| Comparative Example 4 | HTM-2 | 27.3 | 8.82 | Abs. | — | 8.82 | NA | 230 | NA |
| Comparative Example 5 | HTM-3 | 15.2 | 5.55 | Abs. | — | 8.60 | NA | 151 | NA |
| Comparative Example 6 | HTM-4 | 23.2 | 8.88 | Abs. | — | 9.00 | NA | 250 | NA |
| Comparative Example 7 | HTM-5 | 30.1 | 10.18 | Abs. | — | 9.21 | NA | 221 | NA |
| Comparative Example 8 | HTM-6 | 20.0 | 7.22 | Abs. | — | 8.25 | NA | 193 | NA |
| Comparative Example 9 | HTM-9 | 37.0 | 12.55 | Abs. | — | 12.11 | NA | 271 | NA |
| Comparative Example 10 | HTM-10 | 2.8 | 1.22 | Abs. | — | 3.98 | + | 30 | ++ |

| | Exposure memory potential | | Exposure | | Glass transition | |
|---|---|---|---|---|---|---|
| | Potential (V) | Result | memory image | Member resistance | Temp. (° C.) | Result |
| Example 1 | 76 | + | + | + | 69.0 | + |
| Example 2 | 48 | ++ | + | + | 76.1 | + |
| Example 3 | 47 | ++ | + | + | 66.1 | + |
| Example 4 | 61 | + | + | + | 64.8 | + |
| Example 5 | 50 | + | ++ | + | 86.2 | + |
| Example 6 | 76 | + | + | + | 79.8 | + |
| Example 7 | 48 | ++ | + | + | 85.8 | + |
| Example 8 | 45 | ++ | ++ | + | 80.0 | + |
| Example 9 | 40 | ++ | ++ | + | 67.3 | + |
| Example 10 | 44 | ++ | ++ | + | 77.3 | + |
| Example 11 | 39 | ++ | ++ | NA | 65.9 | + |
| Example 12 | 58 | + | + | + | 61.2 | + |
| Example 13 | 43 | ++ | + | + | 78.6 | + |
| Example 14 | 48 | ++ | + | + | 78.2 | + |
| Example 15 | 51 | + | + | + | 78.3 | + |
| Example 16 | 40 | ++ | + | + | 72.0 | + |
| Comparative Example 1 | 73 | + | NA | NA | 74.5 | + |
| Comparative Example 2 | 35 | ++ | ± | NA | 48.0 | NA |
| Comparative Example 3 | 78 | + | NA | NA | 82.1 | + |
| Comparative Example 4 | 55 | + | ± | NA | 85.2 | + |
| Comparative Example 5 | 71 | + | NA | NA | 77.1 | + |
| Comparative Example 6 | 62 | + | NA | NA | 87.2 | + |
| Comparative Example 7 | 70 | + | NA | NA | 80.5 | + |
| Comparative Example 8 | 70 | + | NA | NA | 95.1 | + |
| Comparative Example 9 | 90 | ± | NA | NA | 54.1 | NA |
| Comparative Example 10 | 94 | ± | + | + | 85.1 | + |

In Table 1, "Abs." means "absence" and "NA" means "not available".

INDUSTRIAL APPLICABILITY

Accordingly, the electrophotographic photoconductor of the present comprises a predetermined hole-transfer agent and a predetermined additive, so that the tendency of generating cracks due to skin oil or finger oil can be improved and the generation of exposure memory can be prevented for a long period.

Therefore, the electrophotographic photoconductor of the present invention is expected to contribute to improving durability, speed, and efficiency of any of various image-forming apparatuses such as a copying machine and a printer.

What is claimed is:

1. An electrophotographic photoconductor, comprising a photosensitive layer containing at least a charge-generating agent, a hole-transfer agent, and a binder resin on a conductive substrate, wherein the hole-transfer agent contains compounds represented by any of the following formula (12), (14), (15), (17) and (18) thereof, and the hole-transfer agent has a solubility of 5 to 35% by weight with respect to triglyceride oleate, wherein an amount of the elution of the hole-transfer agent from the surface of the electrophotographic photoconductor per unit area is in a range of 0.05 to 2 g/m$^2$ when the electrophotographic photoconductor is immersed in triglyceride oleate for 20 hours, and the photosensitive layer contains a compound represented by the following general formula (1) as an additive:

(1)

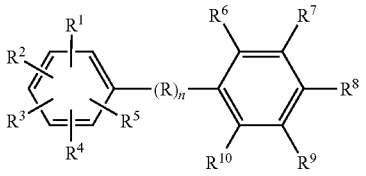

wherein in general formula (1), $R^1$ to $R^{10}$ are each independently selected from a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 6 to 30 carbon atoms, a substituted or unsubstituted cycloalkyl group having 3 to 12 carbon atoms, a hydroxyl group, a cyano group, a nitro group, and an amino group; R is a substituted or unsubstituted alkylene group having 1 to 12 carbon atoms; and n is a integer of 0 to 3, and (12)

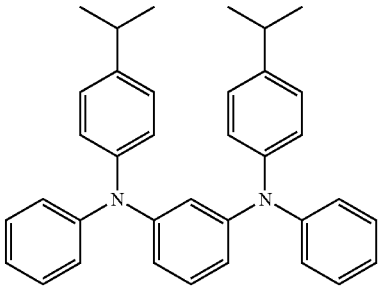

(HTM-1)

(14)

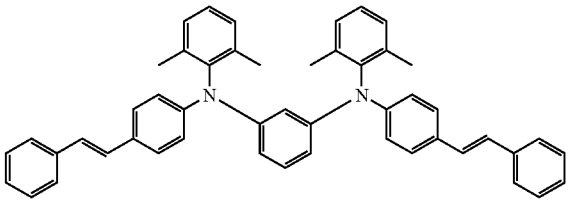

(HTM-3)

-continued (15)

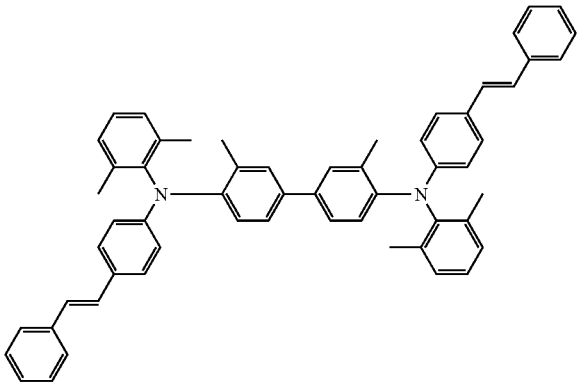

(HTM-4)

(17)

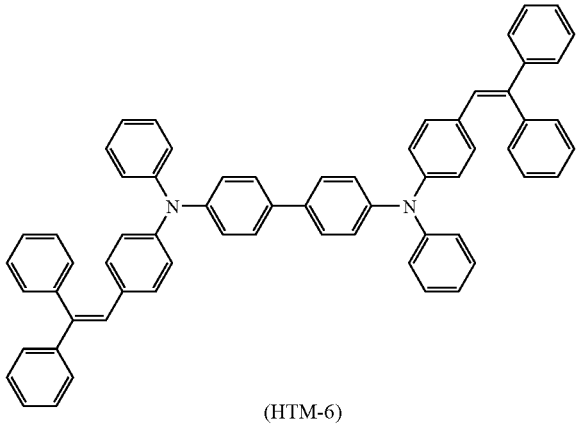

(HTM-6)

(18)

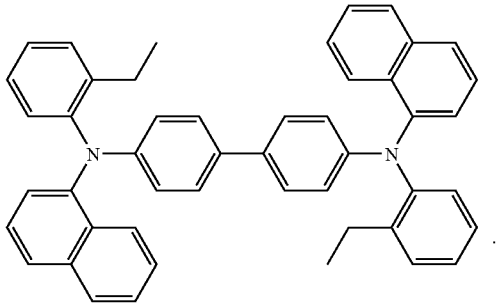

(HTM-7)

2. An image-forming apparatus having an electrophotographic photoconductor, comprising:

an electrostatic charge unit, an exposure unit, an image development unit, and an image transferring unit, which are arranged around the electrophotographic photoconductor, the electrophotographic photoconductor comprising a photosensitive layer containing at least a charge-generating agent, a hole-transfer agent, and a binder resin on a conductive substrate, wherein the hole-transfer agent contains compounds represented by any of the following formula (12), (14), (15), (17) and (18) thereof, and the hole-transfer agent has a solubility of 5 to 35% by weight with respect to triglyceride oleate, wherein an amount of the elution of the hole-transfer agent from the surface of the electrophotographic photoconductor per unit area is in a range of 0.05 to hg/$m^2$ when the electrophotographic photoconductor is immersed in triglyceride oleate for 20 hours, and the photosensitive layer contains a compound represented by the following general formula (1) as an additive:

(1)

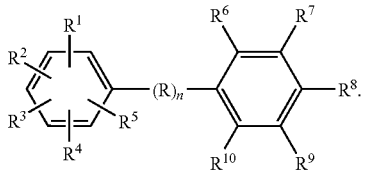

wherein in general formula (1), $R^1$ to $R^{10}$ are each independently selected from a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 6 to 30 carbon atoms, a substituted or unsubstituted cycloalkyl group having 3 to 12 carbon atoms, a hydroxyl group, a cyano group, a nitro group, and an amino group; R is a substituted or unsubstituted alkylene group having 1 to 12 carbon atoms; and n is a integer of 0 to 3, and (12)

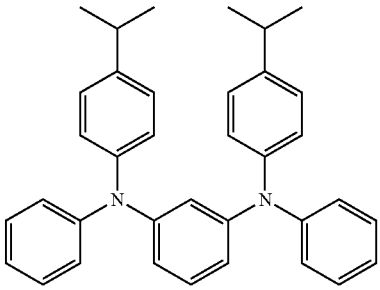

(HTM-1)

(14)

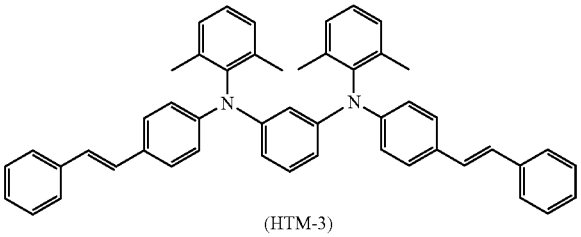

(HTM-3)

-continued (15)

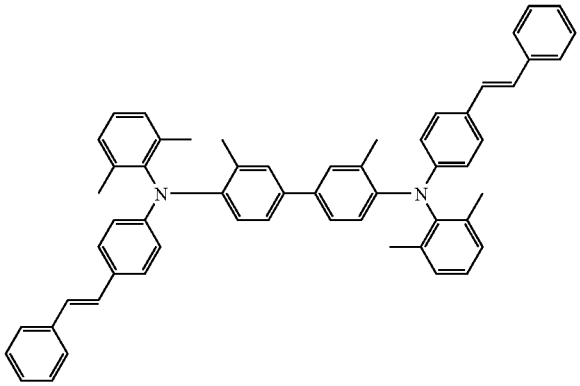

(HTM-4)

(17)

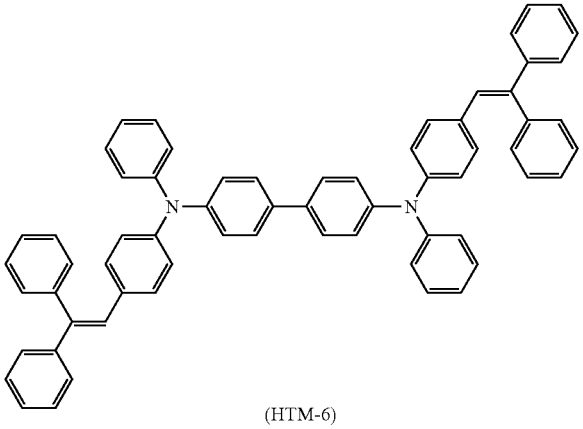

(HTM-6)

(18)

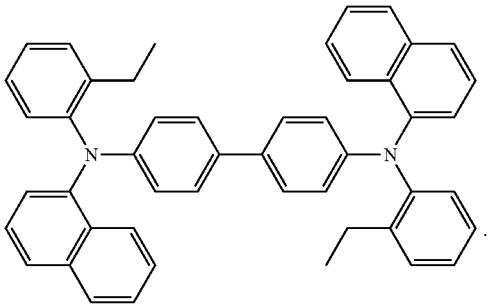

(HTM-7)

3. The image forming apparatus according to claim 2, wherein an amount of the additive added is in a range of 1.5 to 14% by weight with respect to a solid content of the photosensitive layer.

4. The image forming apparatus according to claim 2, wherein a glass transition point (Tg) of the photosensitive layer is 60° C. or more.

5. The image forming apparatus according to claim 2, wherein the additive is a compound represented by any of the following formulae (2) to (7) or a derivative thereof:

(2)
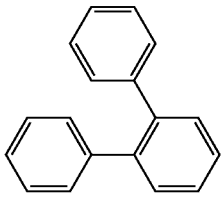
(BP-1)
(3)
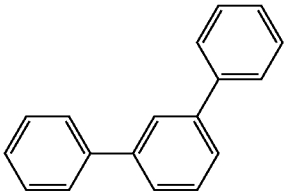
(BP-2)
(4)
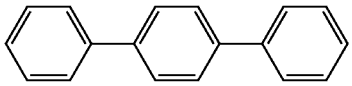
(BP-3)
-continued
(5)
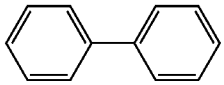
(BP-4)
(6)
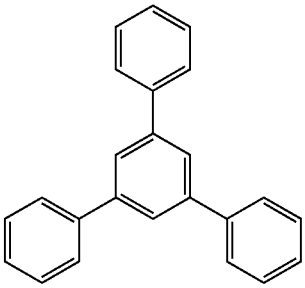
(BP-5)
(7)
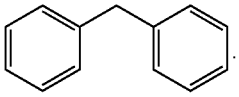
(BP-6)
6. The image forming apparatus according to claim 2, wherein the photosensitive layer is of a mono-layer type.
* * * * *